US009557674B2

(12) United States Patent
Hirai et al.

(10) Patent No.: US 9,557,674 B2
(45) Date of Patent: Jan. 31, 2017

(54) TONER SET, IMAGE FORMING APPARATUS, AND IMAGE FORMING METHOD

(71) Applicant: FUJI XEROX CO., LTD., Tokyo (JP)

(72) Inventors: Sakiko Hirai, Kanagawa (JP); Shotaro Takahashi, Kanagawa (JP); Masaru Takahashi, Kanagawa (JP); Atsushi Sugitate, Kanagawa (JP); Shuji Sato, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 2 days.

(21) Appl. No.: 13/855,337

(22) Filed: Apr. 2, 2013

(65) Prior Publication Data

US 2014/0023964 A1 Jan. 23, 2014

(30) Foreign Application Priority Data

Jul. 19, 2012 (JP) ..... 2012-160264

(51) Int. Cl.
*G03G 13/01* (2006.01)
*G03G 9/09* (2006.01)
*G03G 9/087* (2006.01)

(52) U.S. Cl.
CPC ..... *G03G 9/09* (2013.01); *G03G 9/08782* (2013.01); *G03G 9/0902* (2013.01); *G03G 9/0926* (2013.01)

(58) Field of Classification Search
CPC ..... G03G 9/09; G03G 9/0902
USPC ..... 430/107.1, 108.24, 110.1
See application file for complete search history.

(56) References Cited

U.S. PATENT DOCUMENTS

2011/0262858 A1* 10/2011 Nair et al. ..... 430/110.2
2011/0318683 A1* 12/2011 Kadokura et al. ..... 430/105

FOREIGN PATENT DOCUMENTS

| | | | | |
|---|---|---|---|---|
| JP | A-60-083863 | | 5/1985 | |
| JP | 05-289395 | * | 11/1993 | ..... G03G 9/087 |
| JP | A-2002-229293 | | 8/2002 | |
| JP | 2003-005446 | A | 1/2003 | |
| JP | 2008-521037 | A | 6/2008 | |
| JP | 2011-203548 | A | 10/2011 | |
| JP | 2012-068522 | A | 4/2012 | |
| WO | 2006/056402 | A1 | 6/2006 | |

OTHER PUBLICATIONS

Diamond, "The Handbook of Imaging Materials," Marcel Dekker, 1991, NY, NY, pp. 168-169.*
Diamond, "Handbook of Imaging Materials," Marcel Dekker, NY, NY 1991.*
Translation of JP 05-289395.*
Jan. 5, 2016 Office Action issued in Japanese Application No. 2012-160264.
May 10, 2016 Office Action issued in Japanese Application No. 2012-160264.

* cited by examiner

*Primary Examiner* — Peter Vajda
(74) *Attorney, Agent, or Firm* — Oliff PLC

(57) ABSTRACT

Provided is a toner set including at least a first brilliant toner that contains a brilliant pigment, and a second brilliant toner that contains a brilliant pigment and exhibits a different color from the first brilliant toner.

1 Claim, 8 Drawing Sheets

TONER SET, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2012-160264 filed Jul. 19, 2012.

BACKGROUND

1. Technical Field

The present invention relates to a toner set, an image forming apparatus, and an image forming method.

2. Related Art

For the purpose of forming an image having brilliance similar to metallic luster, a brilliant toner is used.

SUMMARY

According to an aspect of the invention, there is provided a toner set including at least a first brilliant toner that contains a brilliant pigment, and a second brilliant toner that contains a brilliant pigment and exhibits a different color from the first brilliant toner.

BRIEF DESCRIPTION OF THE DRAWINGS

Exemplary embodiments of the present invention will be described in detail based on the following figures, wherein.

DETAILED DESCRIPTION

Hereinafter, a toner set, an image forming apparatus, and an image forming method according to exemplary embodiments of the invention will be described in detail.

Toner Set

A toner set according to an exemplary embodiment at least includes a first brilliant toner that contains at least a brilliant pigment, and a second brilliant toner that contains at least the brilliant pigment and exhibits a different color from the first brilliant toner.

When the toner set according to the exemplary embodiment is used, an image of secondary color or more combination colors with an excellent brilliance is formed. The reason is unclear but is assumed to be as follows.

In the related art, in order to electrophotograpically form a colored image exhibiting brilliance, generally, an image is obtained by superimposing a brilliant toner and a color toner on an intermediate transfer medium, for example, to form a superimposed toner image, transferring the superimposed toner image to a recording medium and thereafter fixing the superimposed toner image transferred on the recording medium.

Figure 1A:
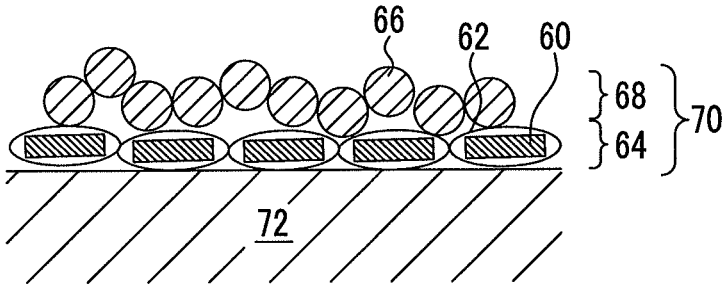
FIGS. 1A to 1C are views showing an example of a process in which a yellow (a primary color exhibiting brilliance) image is electrophotograpically formed by using a toner set of the related art.
Figure 1B:
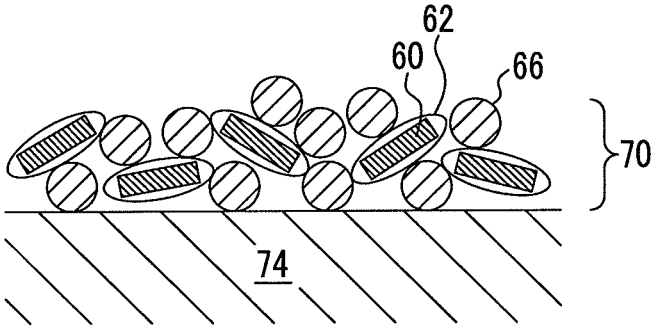
Figure 1C:
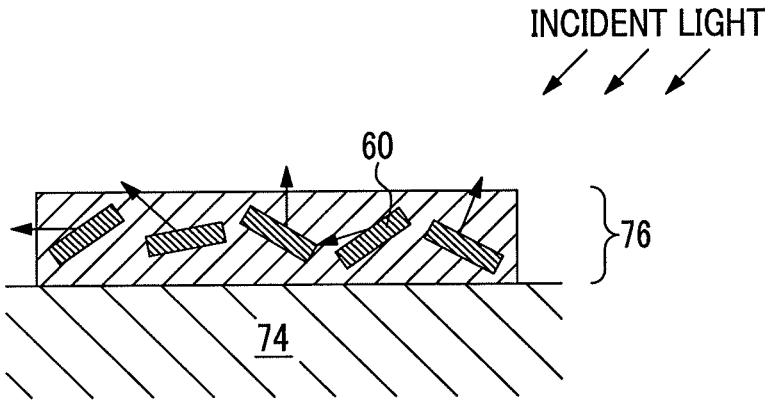

FIGS. 1A to 1C show an example of a process in which a yellow (a primary color exhibiting brilliance) image is electrophotograpically formed by using a toner set of the related art. In FIG. 1A, a silver toner image 64 formed by a silver toner 62 that contains a flake-shape pigment (brilliant pigment) 60 and exhibits brilliance and an yellow toner image 68 formed by a yellow toner 66 are superimposed and thus a superimposed toner image 70 is formed on an intermediate transfer medium 72. A typical color toner such as the yellow toner 66 or a black toner is considered to be in a spherical shape compared to the brilliant toner but a silver toner is considered to be in a flake shape. This is because a flake-shape pigment (such as aluminum) is used as the brilliant pigment 60.

As shown in FIG. 1A, in order to cancel out the charge of toner particles to the maximum extent, it is assumed that the flake-shape silver toner 63 is adhered to the intermediate transfer medium 72 such that the adhering area becomes the maximum. As a result, the brilliant pigment 60 is present in such a manner that the long axis thereof is parallel to the surface of the intermediate transfer medium 72.

Subsequently, as shown in FIG. 1B, the superimposed toner image 70 formed on the intermediate transfer medium 72 is transferred onto a recording medium 74 through a transferring process. In the superimposed toner image 70 transferred onto the recording medium 74, the yellow toner 66 is interposed between the silver toner 62 and the recording medium 74 and this causes the disarray in the orientation of the brilliant pigment 60. That is, there is a case where the long axis of the brilliant pigment 60 included in the silver toner 62 is not parallel to the surface of the recording medium 74. When the superimposed toner image 70 is fixed onto the recording medium 74 to form a fixed toner image 76 in this state, there is a case where the brilliant pigment 60 is fixed such that the long axis thereof is disarrayed to the surface of the recording medium 74 (referring to FIG. 1C).

When the brilliant pigment 60 is fixed in this state, as shown in FIG. 1C, the incident light incident from a given direction is diffusely reflected by the brilliant pigment 60 and thus it becomes difficult for the fixed image to exhibit brilliance.

Figure 2A:
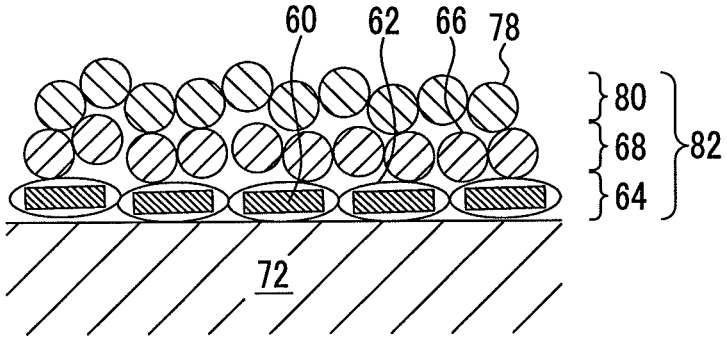
FIGS. 2A to 2C are views showing an example of a process of the related art in which a green (a secondary color exhibiting brilliance) image is electrophotograpically formed by using the toner set of the related art.
Figure 2B:
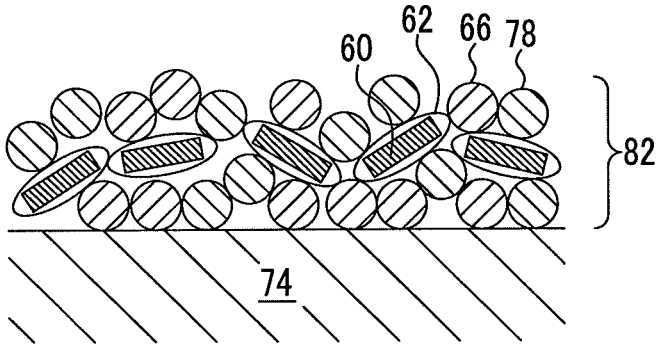
Figure 2C:
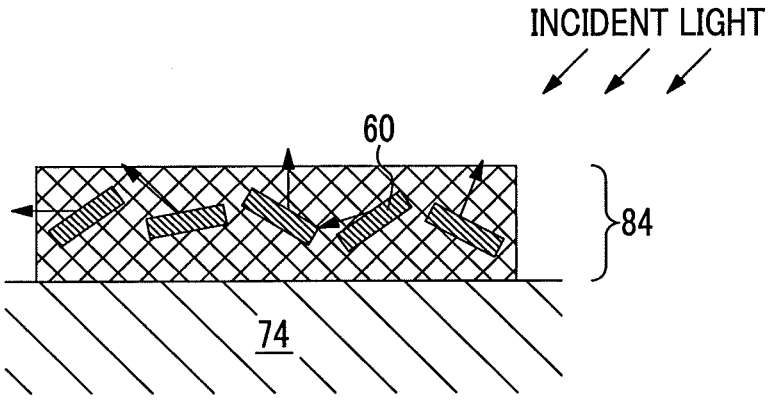

FIGS. 2A to 2C are views showing an example of a process of the related art in which a green (a secondary color exhibiting brilliance) image is electrophotograpically formed by using the toner set of the related art. In FIG. 2A, the silver toner image 64 formed by the silver toner 62 that contains the brilliant pigment 60 and exhibits brilliance, the yellow toner image 68 formed by the yellow toner 66, and a cyan toner image 80 formed by a cyan toner 78 are superimposed and thus a superimposed toner image 82 is formed on the intermediate transfer medium 72.

Subsequently, as shown in FIG. 2B, the superimposed toner image 82 formed on the intermediate transfer medium 72 is transferred onto the recording medium 74 through a transferring process. In the superimposed toner image 82 transferred onto the recording medium 74, the yellow toner 66 and the cyan toner 78 are interposed between the silver toner 62 and the recording medium 74 and this causes the disarray in the orientation of the brilliant pigment 60. That is, there causes a case where the long axis of the brilliant pigment 60 included in the silver toner 62 is not parallel to the surface of the recording medium 74. When the superimposed toner image 82 is fixed onto the recording medium 74 to form a fixed toner image 84 in this state, there is a case where the brilliant pigment 60 is fixed such that the long axis thereof is disarrayed to the surface of the recording medium 74 (referring to FIG. 2C).

When the brilliant pigment 60 is fixed in this state, as shown in FIG. 2C, the incident light incident from a given direction is diffusely reflected by the brilliant pigment 60 and thus it is difficult to exhibit brilliance of the fixed image.

As described above, when a color toner image exhibiting brilliance is formed by using the brilliant toner and the color toner, there is a case where the brilliance of the formed toner image is deteriorated.

Figure 3A:
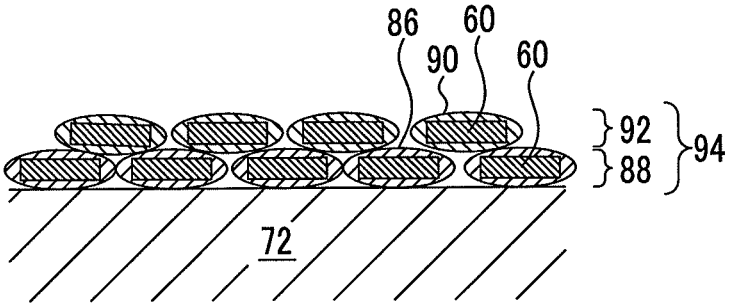
FIGS. 3A to 3C are views showing an example of a process in which a green (the secondary color exhibiting brilliance) image is electrophotograpically formed by using a toner set according to an exemplary embodiment.
Figure 3B:
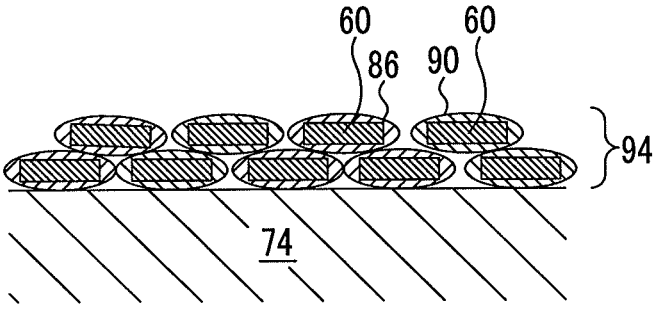
Figure 3C:
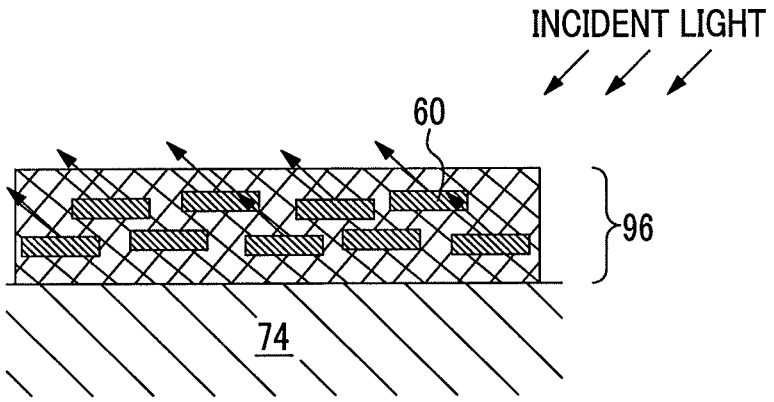

In the exemplary embodiment, a color image exhibiting brilliance is formed by using at least a first brilliant toner and a second brilliant toner. FIGS. 3A to 3C show an example of a process in which a green (the secondary color exhibiting brilliance) image is electrophotograpically formed by using a toner set according to the exemplary embodiment.

In FIG. 3A, a brilliant yellow toner image 88 formed by a flake-shape brilliant yellow toner 86 (first brilliant toner) containing the brilliant pigment 60 and a yellow pigment that is a first colorant and a brilliant cyan toner image 92 formed by a flake-shape brilliant cyan toner 90 (second brilliant toner) containing the brilliant pigment 60 and a cyan pigment that is a second colorant are superimposed and thus a superimposed toner image 94 is formed on the intermediate transfer medium 72.

As shown in FIG. 3A, in order to cancel out the charge of toner particles to the maximum extent, it is assumed that the flake-shape brilliant yellow toner 86 and the flake-shape brilliant cyan toner 90 are adhered on the intermediate transfer medium 72 such that the adhering area becomes the maximum. As a result, the brilliant pigment 60 is present in such a manner that the long axis thereof is parallel to the surface of the intermediate transfer medium 72.

Subsequently, as shown in FIG. 3B, the superimposed toner image 94 formed on the intermediate transfer medium 72 is transferred onto the recording medium 74 through a transferring process. In the transferring process, since both of the brilliant yellow toner 86 and the brilliant cyan toner 90 are a flake shape, the long axis of the brilliant pigment 60 included in the brilliant yellow toner 86 and the brilliant cyan toner 90 easily becomes parallel to the surface of the recording medium 74 and the disarray in the orientation of the brilliant pigment 60 rarely occurs. When the superimposed toner image 94 is fixed onto the recording medium 74 to form a fixed toner image 96 in this state, the brilliant pigment 60 is easily fixed in a state where the long axis thereof is more nearly parallel to the surface of the recording medium 74 (referring to FIG. 3C).

When the brilliant pigment 60 is fixed in this state, as shown in FIG. 3C, the incident light incident from a given direction is easily specularly-reflected by the brilliant pigment 60 and thus it is assumed that the fixed image easily exhibits brilliance.

When tertiary or more combination color image exhibiting brilliance is electrophotograpically formed by using three or more kinds of brilliant toners containing the brilliant pigment and colorants which have a different color from each other, it is also assumed that the fixed image easily exhibits brilliance because of the same reason as the case where the brilliant green (secondary color) image exhibiting brilliance is formed by using the brilliant yellow toner 86 and the brilliant cyan toner 90. As a result, it is assumed that the image of secondary or more combination colors with an excellent brilliance is formed by using the toner set according to the exemplary embodiment.

The term "brilliance" in the exemplary embodiment indicates that an image has brilliance similar to metallic luster when the image formed by the toner according to the exemplary embodiment is visually checked.

The toner set according to the exemplary embodiment is not particularly limited as long as the toner set has at least two kinds of brilliant toners which exhibit brilliance and a different color from each other.

Examples of the combination of the brilliant toners include a toner set which has at least two toners selected from the group consisting of a brilliant cyan toner containing at least a brilliant pigment, a brilliant magenta toner containing at least a brilliant pigment, and a brilliant yellow toner containing at least a brilliant pigment.

In addition, the combination of a brilliant cyan toner containing a brilliant pigment and a blue colorant, a brilliant magenta toner containing a brilliant pigment and a red colorant, and a brilliant yellow toner containing a brilliant pigment and a yellow colorant is exemplified. Moreover, the combination of a brilliant red toner containing a brilliant pigment and a red colorant, a brilliant green toner containing a brilliant pigment and a green colorant, and a brilliant blue toner containing a brilliant pigment and a blue colorant or the combination of a brilliant orange toner containing a brilliant pigment and a orange colorant, a brilliant green toner containing a brilliant pigment and a green colorant, and a brilliant violet toner containing a brilliant pigment and a violet colorant is exemplified.

In addition to at least two kinds of brilliant toners which exhibit brilliance and a different color from each other, the toner set according to the exemplary embodiment may have a well-known toner of the related art not containing a brilliant pigment. Examples of the well-known toner include a magenta toner, a cyan toner, a yellow toner, a black toner, a red toner, a green toner, a blue toner, an orange toner, and a violet toner.

Hereinafter, the brilliant toner according to the exemplary embodiment forming the toner set according to the exemplary embodiment will be described.

In the toner of the exemplary embodiment, when a solid image is formed, a ratio (A/B) of a reflectance A at a light receiving angle of +30° to a reflectance B at a light receiving angle of −30°, which are reflectances measured when the image is irradiated with incident light at an incident angle of −45° using a goniophotometer, is preferably from 2 to 100.

If the ratio (A/B) is equal to or greater than 2, this indicates that light is reflected more toward a side ("angle+" side) opposite to the light incident side than toward a side ("angle−" side) where the incident light enters, that is, this indicates that diffuse reflection of the incident light is inhibited. When the diffuse reflection in which the incident light is reflected to various directions is caused, if the reflected light is visually checked, colors look blurry. Therefore, when the ratio (A/B) is less than 2, if the reflected light is visually checked, luster is not confirmed, thereby causing inferior brilliance in some cases.

On the other hand, when the ratio (A/B) exceeds 100, a viewing angle in which the reflected light may be visually checked is narrowed too much, and specular reflected light components are large. Therefore, a phenomenon in which colors look darkish when viewed from different angles may occur. In addition, it is also difficult to prepare a brilliant toner in which the ratio (A/B) exceeds 100.

The ratio (A/B) is preferably from 50 to 100, more preferably from 60 to 90, and particularly preferably from 70 to 80.

Measurement of Ratio (A/B) Using Goniophotometer

First, an incident angle and a light receiving angle will be described. In the exemplary embodiment, when the measurement is performed using a goniophotometer, the incident angle is set to −45°. This is because the sensitivity of the measurement is high with respect to images of a wide range of gloss level.

In addition, the reason why the light receiving angle is set to −30° and +30° is that the sensitivity of the measurement is the highest for evaluating images having and not having the impression of brilliance.

Next, the method of measuring the ratio (A/B) will be described.

In the exemplary embodiment, when the ratio (A/B) is measured, first, a "solid image" is formed in the following manner. A developer as a sample is filled in a developer unit of a DocuCentre-III C7600 manufactured by Fuji Xerox Co., Ltd., and a solid image in which an amount of toner applied is 4.5 g/cm$^2$ is formed on a sheet of recording paper (OK Topcoat+Paper manufactured by Oji Paper Co., Ltd.) at a fixing temperature of 190° C. and at a fixing pressure of 4.0 kg/cm$^2$. The "solid image" refers to an image of 100% printing rate.

Using a goniospectrocolorimeter GC5000L manufactured by NIPPON DENSHOKU INDUSTRIES CO., LTD. as a goniophotometer, incident light that enters the solid image at an incident angle of −45° enters the image portion of the formed solid image, and the reflectance A at a light receiving angle of +30° and the reflectance B at a light receiving angle of −30° are measured. The reflectances A and B are measured with respect to light having a wavelength ranging from 400 nm to 700 nm at an interval of 20 nm, and the average value of the reflectances at respective wavelengths is calculated to obtain each of the reflectances A and B. The ratio (A/B) is calculated from the measurement results.

Configuration of Brilliant Toner

From the viewpoint of satisfying the ratio (A/B) described above, the brilliant toner according to the exemplary embodiment may preferably meet the requirements (1) and (2) below.

(1) The brilliant toner has an average equivalent circle diameter D larger than an average maximum thickness C.

(2) When a cross section of the brilliant toner in a thickness direction thereof is observed, the number of pigment particles arranged so that an angle formed by a long axis direction of the brilliant toner in the cross section and a long axis direction of a pigment particle is in a range of −30° to +30° is equal to or greater than 60% of the total number of the observed pigment particles.

Figure 4:
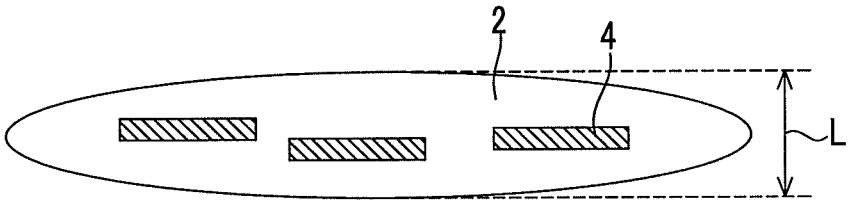
FIG. 4 is a cross-sectional view schematically showing an example of brilliant toner particles according to an exemplary embodiment.

Herein, FIG. 4 is a cross-sectional view schematically showing the toner (brilliant toner) which satisfies the requirements (1) and (2) described above. In addition, the schematic view shown in FIG. 4 is a cross-sectional view of the brilliant toner in a thickness direction thereof.

A brilliant toner 2 shown in FIG. 4 is a flake-shape toner having an equivalent circle diameter larger than a thickness L and contains a flake-shape pigment particle 4 (corresponding to a brilliant pigment).

As shown in FIG. 4, in a case where the brilliant toner 2 has a flake shape having an equivalent circle diameter larger than a thickness L, when the brilliant toner is moved to an image holing member, an intermediate transfer medium, a recording medium, or the like in a step of development or a step of transferring in image formation, the brilliant toner tends to move so as to cancel out the charge of the brilliant toner to the maximum extent. Therefore, it is considered that the brilliant toner is arranged such that the adhering area becomes the maximum. That is to say, it is considered that the flake-shape brilliant toner is arranged such that the flat surface side of the brilliant toner faces a surface of a recording medium onto which the brilliant toner is finally transferred. Moreover, in a step of fixing in image formation, it is considered that the flake-shape brilliant toner is also arranged by the pressure during fixing such that the flat surface side of the brilliant toner faces the surface of the recording medium.

Accordingly, among the flake-shape pigment particles contained in the brilliant toner, pigment particles that satisfy the requirement "an angle formed by a long axis direction of the brilliant toner in the cross section and a long axis direction of a pigment particle is in a range of −30° to +30" described in (2) above are considered to be arranged such that the surface side, which provides the maximum area, faces the surface of the recording medium. When an image formed in this manner is irradiated with light, it is considered that the proportion of pigment particles, which cause diffuse reflection of incident light, is reduced and thus the above-described range of the ratio (A/B) may be achieved. Further, if the proportion of pigment particles, which cause diffuse reflection of incident light, is reduced, the reflected light intensity varies greatly when viewed from different angles, thereby obtaining more ideal brilliance.

Next, the composition of the brilliant toner according to the exemplary embodiment will be described.

Brilliant Pigment

As a brilliant pigment contained in the brilliant toner according to the exemplary embodiment, different or same kinds of brilliant pigments may be used in each brilliant toner.

Examples of the brilliant pigments used in the exemplary embodiment include the following: powders of metals such as aluminum, brass, bronze, nickel, stainless steel and zinc; flaky inorganic crystal substrates coated with a thin layer, such as, mica, barium sulfate, a layer silicate, and a silicates of layer aluminum which are coated with titanium oxide or yellow iron oxide; single-crystal plate-like titanium oxide; basic carbonate; bismuth oxychloride; natural guanine; flaky glass particles; and metal-deposited flaky glass particles. The brilliant pigments used in the exemplary embodiment are not particularly limited as long as the brilliant pigments have brilliance.

The content of the brilliant pigment in the brilliant toner according to the exemplary embodiment is preferably from 4% by weight to 55% by weight, with respect to a binder resin described later. When the content of the brilliant pigment is less than 4% by weight, brilliance may be deteriorated in some cases. When the content of the brilliant pigment exceeds 55% by weight, the smoothness of the fixed image is deteriorated. As a result, brilliance may be deteriorated in some cases.

Colorant

As a colorant used in the exemplary embodiment, a dye or a pigment may be used, but from the viewpoint of light resistance and water resistance, a pigment is preferably used. The colorant may be used alone or in combination of two or more kinds thereof.

Examples of the colorant which may be used in the exemplary embodiment include the following.

Examples of a yellow colorant include chrome yellow, zinc yellow, yellow iron oxide, cadmium yellow, Hansa Yellow, Hansa Yellow 10G, Benzidine Yellow G, Benzidine Yellow GR, Suren Yellow, Quinoline Yellow, and Permanent Yellow NCG.

Examples of a blue colorant include Prussian Blue, cobalt blue, Alkali Blue Lake, Victoria Blue Lake, Fast Sky Blue, Indanthrene Blue BC, Aniline Blue, Ultramarine Blue, Calco Oil Blue, Methylene Blue Chloride, Phthalocyanine Blue, Phthalocyanine Green, and Malachite Green Oxalate.

Examples of a red colorant include red iron oxide, cadmium red, red lead oxide, mercury sulfide, Watchyoung Red, Permanent Red 4R, Lithol Red, Brilliant Carmine 3B, Brilliant Carmine 6B, Du Pont Oil Red, Pyrazolone Red, Rhodamine B Lake, Lake Red C, Rose Bengal, Eoxine Red, and Alizarin Lake.

Examples of a green colorant include chromium oxide, chromium green, Pigment Green, Malachite Green Lake and Final Yellow Green G.

Examples of an orange colorant include red chrome yellow, molybdenum orange, Permanent Orange GTR, Pyrazolone Orange, Vulkan Orange, Benzidine Orange G, Indanthrene Brilliant Orange RK and Indanthrene Brilliant Orange GK.

Examples of a violet colorant include manganese violet, Fast Violet B, and Methyl Violet Lake.

Examples of a black colorant include carbon black, copper oxide, manganese dioxide, aniline black, activated carbon, non-magnetic ferrite and magnetite.

The content of the colorant in the brilliant toner according to the exemplary embodiment is preferably from 0.05% by weight to 12% by weight, and more preferably from 0.5% by weight to 8% by weight, with respect to a binder resin described later. When the content of the colorant is less than 0.05% by weight, the gradation of an image may be deteriorated in some cases. When the content of the colorant exceeds 12% by weight, it may be difficult to secure brilliance in some cases.

Binder Resin

The brilliant toner according to the exemplary embodiment may contain a binder resin.

Examples of the binder resin which is used in the exemplary embodiment include ethylene-based resins such as polyester, polyethylene and polypropylene; styrene-based resins such as polystyrene and α-polymethylstyrene; (meth) acrylic resins such as polymethyl methacrylate and polyacrylonitrile; polyamide resins; polycarbonate resins; polyether resins; and copolymer resins thereof. Among these resins, polyester resins are preferably used from the viewpoint of high smoothness on a surface of a fixed image and superior brilliance.

Hereinafter, polyester resins that are particularly preferably used will be described.

The polyester resins according to the exemplary embodiment may be those obtained by, for example, polycondensation of mainly a polyvalent carboxylic acid and a polyol.

Examples of the polyvalent carboxylic acid include aromatic carboxylic acids such as terephthalic acid, isophthalic acid, phthalic anhydride, trimellitic anhydride, pyromellitic acid, and naphthalenedicarboxylic acid; aliphatic carboxylic acids such as maleic anhydride, fumaric acid, succinic acid, alkenyl succinic anhydride, and adipic acid; and alicyclic carboxylic acids such as cyclohexanedicarboxylic acid. These polyvalent carboxylic acids are used alone or in combination of two or more kinds thereof.

Among these polyvalent carboxylic acids, the aromatic carboxylic acids are preferably used. Furthermore, in order to improve a fixing property and to form a cross-linked structure or a branched structure, a trivalent or higher valent carboxylic acid (such as trimellitic acid or an acid anhydride thereof) is preferably used in combination with a dicarboxylic acid.

Examples of the polyol include aliphatic diols such as ethylene glycol, diethylene glycol, triethylene glycol, propylene glycol, butanediol, hexanediol, neopentyl glycol, and glycerin; alicyclic diols such as cyclohexanediol, cyclohexanedimethanol, and hydrogenated bisphenol A; and aromatic diols such as ethylene oxide adducts of bisphenol A and propylene oxide adducts of bisphenol A. These polyols are used alone or in combination of two or more.

Among these polyols, aromatic diols and alicyclic diols are preferable. Among these, aromatic diols are more preferable. Furthermore, in order to further improve a fixing property and to form a cross-linked structure or a branched structure, a trivalent or higher valent polyol (such as glycerin, trimethylolpropane, or pentaerythritol) may also be used in combination with a diol.

Method of Preparing Polyester Resin

A method of preparing a polyester resin is not particularly limited, and the polyester resin is prepared by a normal polyester polymerization method in which an acid component is reacted with an alcohol component. For example, the polyester resin is prepared by properly employing a direct polycondensation method, an ester interchange method, or the like depending on the types of monomers used. The molar ratio (acid component/alcohol component) in the reaction between the acid component and the alcohol component is different depending on the reaction conditions and the like. However, in order to obtain a high molecular weight, the molar ratio is preferably about 1/1 in general.

Examples of catalysts usable for preparing the polyester resin include alkali metal compounds such as sodium or lithium; compounds of an alkaline earth metal such as magnesium or calcium; compounds of a metal such as zinc, manganese, antimony, titanium, tin, zirconium, or germanium; phosphorous acid compounds; phosphoric acid compounds; and amine compounds.

Release Agent

The brilliant toner according to the exemplary embodiment may contain a release agent.

Examples of the release agent which is used in the exemplary embodiment include paraffin wax such as low-molecular weight polypropylene and low-molecular weight polyethylene; silicone resins; rosins; rice wax; and carnauba wax. The melting temperature of the release agent is preferably from 50° C. to 100° C., and more preferably from 60° C. to 95° C.

The content of the release agent in the brilliant toner is preferably from 0.5% by weight to 15% by weight, and more preferably from 1.0% by weight to 12% by weight.

Other Additives

Besides the components described above, other components such as an internal additive, a charge control agent, an inorganic powder (inorganic particles), and organic particles may also be used in the exemplary embodiment, as necessary.

Examples of the charge control agent include quaternary ammonium salt compounds, nigrosine compounds, dyes containing a complex of aluminum, iron, chromium or the like, and triphenylmethane-based pigments.

Examples of the inorganic particles include known inorganic particles such as silica particles, titanium oxide particles, alumina particles, cerium oxide particles, and particles obtained by hydrophobizing the surfaces of these particles. These inorganic particles may be used alone or in combinations of two or more kinds thereof. Among these inorganic particles, silica particles, which have a refractive index lower than that of the above-described binder resin, are preferably used. The silica particles may be subjected to various surface treatments. For example, silica particles surface-treated with a silane coupling agent, a titanium coupling agent, silicone oil, or the like are preferably used.

Characteristics of Brilliant Toner

Average Maximum Thickness C and Average Equivalent-Circle Diameter D

As described in (1) above, the brilliant toner according to the exemplary embodiment preferably has the average equivalent-circle diameter D larger than the average maximum thickness C thereof. Moreover, the ratio (C/D) of the average maximum thickness C to the average equivalent-circle diameter D is more preferably in a range of from 0.001 to 0.500, further preferably in a range of from 0.010 to 0.200, and particularly preferably in a range of from 0.050 to 0.100.

When the ratio (C/D) is 0.001 or more, the strength of the brilliant toner may be ensured, and breakage of the toner due to a stress during image formation may be suppressed. Thus, a decrease in charges, the decrease being caused by exposure of the pigment, and fogging caused as a result thereof may be suppressed. On the other hand, when the ratio (C/D) is 0.500 or less, a good brilliance may be obtained.

The average maximum thickness C and the average equivalent-circle diameter D are measured by the methods below.

Brilliant toner particles are placed on a smooth surface and uniformly dispersed by applying vibrations. One thousand brilliant toner particles are observed with a color laser microscope "VK-9700" (manufactured by Keyence Corporation) at a magnification of 1,000 times to measure the maximum thickness C and the equivalent-circle diameter D of a surface viewed from the top, and the arithmetic averages thereof are calculated to determine the average maximum thickness C and the average equivalent-circle diameter D.

Angle Formed by Long Axis Direction of Brilliant Toner in Cross Section and Long Axis Direction of Pigment Particles As described in (2) above, when a cross section of the brilliant toner in the thickness direction thereof is observed, the number of pigment particles arranged so that an angle formed by a long axis direction of the brilliant toner in the cross section and a long axis direction of a pigment particle is in a range of −30° to +30° is preferably 60% or more of the total number of the observed pigment particles. Furthermore, the number is more preferably from 70% to 95%, and particularly preferably from 80% to 90%.

When the above number is 60% or more, a good brilliance may be obtained.

Herein, a method of observing a cross section of the brilliant toner will be described.

Brilliant toner particles are embedded in a mixture of a bisphenol A-type liquid epoxy resin and a curing agent, and a sample for cutting is then prepared. Next, the sample for cutting is cut at −100° C. using a cutting machine with a diamond knife (a LEICA Ultramicrotome (manufactured by Hitachi Technologies Corporation) is used in the exemplary embodiment) to prepare a sample for observation. The obtained sample is observed with a transmission electron microscope (TEM) at a magnification of about 5,000 times to observe cross sections of the brilliant toner particles. For observed 1,000 brilliant toner particles, the number of pigment particles arranged so that the angle formed by the long axis direction of a brilliant toner in the cross section and the long axis direction of a pigment particle is in a range of −30° to +30° is counted using image analysis software, and the proportion thereof is calculated.

The term "long axis direction of a brilliant toner in the cross section" refers to a direction orthogonal to a thickness direction of the brilliant toner having an average equivalent-circle diameter D larger than the average maximum thickness C, and the term "long axis direction of a pigment particle" refers to a length direction of the pigment particle.

The volume average particle diameter of the brilliant toner according to the exemplary embodiment is preferably from 1 μm to 30 μm, more preferably from 3 μm to 20 μm, and further preferably from 5 μm to 10 μm.

The volume average particle diameter $D_{50v}$ is determined as follows. A cumulative volume distribution curve and a cumulative number distribution curve are drawn from the smaller particle diameter end, respectively, for each particle diameter range (channel) divided on the basis of a particle diameter distribution measured with a measuring instrument such as a Multisizer II (manufactured by Beckman Coulter Inc.). The particle diameter providing 16% accumulation is defined as that corresponding to volume $D_{16v}$ and number $D_{16p}$, the particle diameter providing 50% accumulation is defined as that corresponding to volume $D_{50v}$ and number $D_{50p}$, and the particle diameter providing 84% accumulation is defined as that corresponding to volume $D_{84v}$ and number $D_{84p}$. The volume average particle diameter distribution index (GSDv) is calculated as $(D_{84v}/D_{16v})^{1/2}$ using these values.

Method of Preparing Brilliant Toner

The brilliant toner according to the exemplary embodiment may be prepared by preparing brilliant toner particles and then adding an external additive to the brilliant toner particles.

A method of preparing brilliant toner particles is not particularly limited, and examples thereof include well-known methods including a dry method such as a kneading and pulverizing method and wet methods such as an emulsification aggregation method, and a suspension polymerization method.

In the kneading and pulverizing method, the respective materials including a colorant are mixed, the resultant is melted and kneaded with a kneader, an extruder or the like, and the obtained melted and kneaded material is coarsely pulverized and then finely pulverized with a jet mill or the like, followed by classification with an air classifier. As a result, brilliant toner particles having a desired particle diameter are obtained.

Among the methods, an emulsification aggregation method is preferable from the viewpoints that the shape and particle diameter of brilliant toner particles are easily controlled and a control range of a structure of toner particles, such as a core-shell structure, is wide. Hereinafter, a method of preparing brilliant toner particles with the emulsification aggregation method will be described in detail.

The emulsification aggregation method according to the exemplary embodiment includes an emulsification process of emulsifying base materials of brilliant toner particles and forming resin particles (emulsified particles), an aggregation process of forming aggregates of the resin particles, and a coalescence process of coalescing the aggregates.

Emulsification Process

A resin particle dispersion may be prepared emulsifying a solution, in which an aqueous medium and a binder resin are mixed, by a disperser applying a shearing force thereto, and other well-known polymerization methods such as an emulsification polymerization method, a suspension polymerization method, and a dispersion polymerization method may also be used. At this time, particles may be formed by heating a resin component to lower the viscosity thereof. In addition, in order to stabilize the dispersed resin particles, a dispersant may be used. Furthermore, when resin is dissolved in an oil-based solvent having relatively low solubility in water, the resin is dissolved in the solvent and particles thereof are dispersed in water with a dispersant and a polymer electrolyte, followed by heating and reduction in pressure to evaporate the solvent. As a result, the resin particle dispersion is prepared.

Examples of the aqueous medium include water such as distilled water or ion exchange water; and alcohols, and water is preferable.

In addition, examples of the dispersant which is used in the emulsification process include a water-soluble polymer such as polyvinyl alcohol, methyl cellulose, ethyl cellulose, hydroxyethyl cellulose, carboxymethyl cellulose, sodium polyacrylate, or sodium polymethacrylate; a surfactant such as an anionic surfactant (for example, sodium dodecylbenzenesulfonate, sodium octadecylsulfate, sodium oleate, sodium laurate, or potassium stearate), a cationic surfactant (for example, laurylamine acetate, stearylamine acetate, or lauryltrimethylammonium chloride), a zwitterionic surfactant (for example, lauryl dimethylamine oxide), or a nonionic surfactant (for example, polyoxyethylene alkyl ether, polyoxyethylene alkyl phenyl ether, or polyoxyethylene alkylamine); and an inorganic salt such as tricalcium phosphate, aluminum hydroxide, calcium sulfate, calcium carbonate, or barium carbonate.

Examples of the disperser which is used for preparing an emulsion include a homogenizer, a homomixer, a pressure kneader, an extruder, and a media disperser. With regard to the size of the resin particles, the average particle diameter (volume average particle diameter) thereof is preferably less than or equal to 1.0 μm, more preferably from 60 nm to 300 nm, and still more preferably from 150 nm to 250 nm. When the volume average particle diameter thereof is greater than or equal to 60 nm, the resin particles are likely to be unstable in the dispersion and thus the aggregation of the resin particles may be easy. In addition, when the volume average particle diameter thereof is less than or equal to 1.0 μm, the particle diameter distribution of the brilliant toner particles may be narrowed.

When a release agent dispersion is prepared, a release agent is dispersed in water with an ionic surfactant and a polyelectrolyte such as a polyacid or a polymeric base and the resultant is heated at a temperature higher than or equal to the melting point of the release agent, followed by dispersion using a homogenizer or a pressure extrusion type disperser with which strong shearing force is applied. Through the above-described process, a release agent dispersion is obtained. During the dispersion, an inorganic compound such as polyaluminum chloride may be added to the dispersion. Preferable examples of the inorganic compound include polyaluminum chloride, aluminum sulfate, high basic polyaluminum chloride (BAC), polyaluminum hydroxide, and aluminum chloride. Among these, polyaluminum chloride and aluminum sulfate are preferable. The release agent dispersion is used in the emulsification aggregation method, but may also be used when the brilliant toner is prepared in the suspension polymerization method.

Through the dispersion, the release agent dispersion having release agent particles with a volume average particle diameter of 1 μm or less is obtained. It is more preferable that the volume average particle diameter of the release agent particles is from 100 nm to 500 nm.

When the volume average particle diameter is greater than or equal to 100 nm, although being affected by properties of the binder resin to be used, in general, it is easy to mix a release agent component into the brilliant toner. In addition, when the volume average particle diameter is less than or equal to 500 nm, the dispersal state of the release agent in the brilliant toner may be satisfactory.

When a colorant dispersion and a brilliant pigment dispersion are prepared, a well-known dispersion method may be used. For example, general dispersion units such as a rotary-shearing homogenizer, and a ball mill, a sand mill, a dyno mill, or an ultimizer having a medium are used, and the dispersion method is not limited thereto. The colorant is dispersed in water with an ionic surfactant and a polyelectrolyte such as a polyacid or a polymeric base.

The brilliant pigment and the binder resin may be dispersed and dissolved in a solvent and mixed, and the resultant may be dispersed in water through phase inversion emulsification or shearing emulsification, thereby preparing a dispersion of the brilliant pigment coated with the binder resin.

Aggregation Process

In the aggregation process, the resin particle dispersion, the colorant dispersion, the brilliant pigment dispersion, the release agent dispersion and the like are mixed to obtain a mixture and the mixture is heated at the glass transition temperature or less of the resin particles and aggregated to form aggregated particles. In most cases, the aggregated particles are formed by adjusting the pH value of the mixture to be acidic under stirring. The pH value is preferably from 2 to 7. At this time, use of a coagulant is also effective.

In the aggregation process, the release agent dispersion and other various dispersions such as the resin particle dispersion may be added and mixed at once or may be added many times in separate portions.

As the coagulant, a surfactant having a reverse polarity to that of a surfactant which is used as the dispersant, an inorganic metal salt, and a divalent or higher valent metal complex may be preferably used. In particular, the metal complex is particularly preferable because the amount of the surfactant used may be reduced and the charging characteristics are improved.

Preferable examples of the inorganic metal salt include an aluminum salt and a polymer thereof. In order to obtain a narrower particle diameter distribution, a divalent inorganic metal salt is preferable to a monovalent inorganic metal salt, a trivalent inorganic metal salt is preferable to a divalent inorganic metal salt, and a tetravalent inorganic metal salt is preferable to a trivalent inorganic metal salt. Even in a case of inorganic metal salts having the same valence, a polymeric type of inorganic metal salt polymer is more preferable.

In the exemplary embodiment, in order to obtain a narrower particle diameter distribution, a tetravalent inorganic metal salt polymer containing aluminum is preferably used.

After the aggregated particles have desired particle diameters, the resin particle dispersion is additionally added (coating process). According to this, a brilliant toner having a configuration in which the surfaces of core aggregated particles are coated with resin may be prepared. In this case, the release agent and the colorant and the brilliant pigment are not easily exposed to the surface of the brilliant toner, which is preferable from the viewpoints of charging characteristics and developability. In a case of further addition, a coagulant may be added or the pH value may be adjusted before further addition.

Coalescence Process

In the coalescence process, under stirring conditions based on the aggregation process, by increasing the pH value of a suspension of the aggregated particles to be in a range of from 3 to 9, the aggregation is stopped. By performing heating at the glass transition temperature or higher of the resin, the aggregated particles are coalesced. In addition, when the resin is used for coating, the resin is also coalesced and coats the core aggregated particles. The heating may be performed for a period during which the aggregated particles are coalesced and may be approximately from 0.5 hour to 10 hours.

After coalescing, cooling is carried out to obtain coalesced particles. In addition, in a cooling process, a cooling rate may be reduced around the glass transition temperature of the resin (the range of the glass transition temperature ±10° C.), that is, slow cooling may be carried out to promote crystallization.

The coalesced particles, which are obtained by coalescing, may be subjected to a sold-liquid separation process such as filtration, or, as necessary, a cleaning process and drying process to obtain brilliant toner particles.

In order to adjust charging, impart fluidity, and impart a charge exchange property, inorganic oxides or the like which are represented by silica, titania, and alumina may be added and attached to the obtained brilliant toner particles, as an external additive. The above-described processes may be performed with a V-shape blender, a Henschel mixer, a Loedige mixer or the like and the attachment is performed in plural steps. The amount of the external additive added is preferably in a range of from 0.1 part to 5 parts and more preferably in a range of from 0.3 part to 2 parts, with respect to 100 parts of the brilliant toner particles.

After the external addition, coarse brilliant toner particles may be removed, as necessary, using an ultrasonic sieving machine, a vibrating sieving machine, an air classifier or the like.

In addition to the above-described inorganic oxides or the like, other components (particles) such as a charge-controlling agent, organic particles, a lubricant, and an abrasive may be added as an external additive.

The charge-controlling agent is not particularly limited, and a colorless or light-color charge-controlling agent is preferably used. Examples thereof include quaternary ammonium salt compounds, nigrosine compounds, a complex of aluminum, iron, chromium, or the like, and triphenylmethane pigments.

Examples of the organic particles include particles of vinyl resins, polyester resins, silicone resins, and the like, which are generally used for surfaces of toner particles as the external additive. In addition, the organic particles and inorganic particles are used as a liquid auxiliary agent, a cleaning aid, or the like.

Examples of the lubricant include fatty acid amides such as ethylene bis stearamide and oleamide; and fatty acid metal salts such as zinc stearate and calcium stearate.

Examples of the abrasive include silica, alumina, and cerium oxide described above.

A well-known toner of the related art not containing a brilliant pigment is prepared by the same process as the method of preparing the brilliant toner according to the exemplary embodiment, except that a brilliant pigment is not used.

Developer

The brilliant toner according to the exemplary embodiment may be used as a single-component developer as it is or a two-component developer in which a carrier is mixed with the brilliant toner.

The carrier which may be used for the two-component developer is not particularly limited, and a well-known carrier may be used. For example, magnetic metals such as iron oxide, nickel, or cobalt and magnetic oxides such as ferrite or magnetite, a resin-coated carrier which has a resin coating layer on the surface of a core material formed of magnetic metal and magnetic oxide, and a magnetic powder-dispersed carrier may be used. In addition, a resin-dispersed carrier in which a conductive material or the like is dispersed in a matrix resin may be used.

Examples of the coating resin and the matrix resin which are used for the carrier include polyethylene, polypropylene, polystyrene, polyvinyl acetate, polyvinyl alcohol, polyvinyl butyral, polyvinyl chloride, polyvinyl ether, polyvinylketone, vinyl chloride-vinyl acetate copolymer, styrene-acrylic acid copolymer, straight silicone resin having organosiloxane bonds or a modified product thereof, fluororesin, polyester, polycarbonate, phenol resin, and epoxy resin. However, the coating resin and the matrix resin are not limited to these examples.

Examples of the conductive material include metals such as gold, silver, and copper, carbon black, titanium oxide, zinc oxide, barium sulfate, aluminum borate, potassium titanate, and tin oxide. However, the conductive material is not limited to these examples.

Examples of the core material of the carrier include a magnetic metal such as iron, nickel or cobalt, a magnetic oxide such as ferrite or magnetite, and glass beads. In order to apply a magnetic brush method to the carrier, a magnetic material is preferable. In general, the volume average particle diameter of the core material of the carrier is in a range of from 10 μm to 500 μm and preferably in a range of from 30 μm to 100 μm.

In order to coat the surface of the core material of the carrier with resin, there may be used, for example, a coating method using a coating layer-forming solution which is obtained by dissolving the coating resin and, as necessary, various additives in an appropriate solvent. The solvent is not particularly limited and may be selected according to coating resin to be used, coating aptitude or the like.

Specific examples of the resin coating method include a dipping method in which the core material of the carrier is dipped in the coating layer-forming solution, a spray method in which the coating layer-forming solution is sprayed on the surface of the core material of the carrier, a fluid bed method in which the coating layer-forming solution is sprayed on the core material of the carrier in a state of floating through flowing air, and a kneader coater method in which the core material of the carrier and the coating layer-forming solution are mixed in a kneader coater and the solvent is removed.

In a two-component developer, the mixing ratio (weight ratio) of the brilliant toner according to the exemplary embodiment and the carrier is preferably in a range of from 1:100 to 30:100 (brilliant toner:carrier) and more preferably in a range of from 3:100 to 20:100.

Image Forming Apparatus and Image Forming Method

An image forming apparatus according to an exemplary embodiment includes plural toner image forming units that include at least a first toner image forming unit which forms a first toner image by using a first brilliant toner containing at least a brilliant pigment and a second toner image forming unit which forms a second toner image by using a second brilliant toner containing at least a brilliant pigment and exhibiting a different color from the first brilliant toner, a transfer unit that transfers at least the first toner image and the second toner image onto a recoding medium in a overlapping manner, and a fixing unit that fixes at least the first toner image and the second toner image on the recording medium.

The image forming apparatus according to the exemplary embodiment may include at least the first toner image forming unit and the second toner image forming unit as a toner image forming unit, but may include other toner image forming units that form other toner images other than the first toner image and the second toner image. Examples of the other toner image forming units include a third toner image forming unit that forms a third toner image by using a third brilliant toner containing at least a brilliant pigment and exhibiting a different color from the first brilliant toner and the second brilliant toner or one or two or more toner image forming units that form a toner image not exhibiting brilliance.

The toner image forming unit according to the exemplary embodiment may include a latent image holding member, a charging unit that charges the surface of the latent image holding member, an electrostatic image forming unit that forms an electrostatic image on the surface of the latent image holding member, and a developing unit that develops the electrostatic image using a developer containing a brilliant toner and forms a toner image.

The image forming apparatus according to the exemplary embodiment executes an image forming method according to the exemplary embodiment that includes forming plural toner image including at least the forming of a first toner image by using a first brilliant toner containing at least a brilliant pigment and the forming of a second toner image by using a second brilliant toner containing at least a brilliant pigment and exhibiting a different color from the first brilliant toner, transferring at least the first toner image and the second toner image onto a recoding medium in a overlapping manner, and fixing at least the first toner image and the second toner image on the recording medium.

The image forming apparatus according to the exemplary embodiment may be, for example, an image forming apparatus that sequentially and repeatedly primary transfers each toner image held on the latent image holding member to an intermediate transfer medium or a tandem type image forming apparatus that arranges plural latent image holding members having a developing unit for each color on the intermediate transfer medium in series.

The image forming apparatus according to the exemplary embodiment may be a cartridge structure (process cartridge) in which a portion including the developing unit that accommodates the developer is detachable and attachable to the image forming apparatus and may be a cartridge structure (toner cartridge) in which a portion that accommodates a supplement toner to be supplied to the developing unit is detachable and attachable to the image forming apparatus.

Hereinafter, with reference to the drawing, the image forming apparatus according to the exemplary embodiment will be described.

Figure 5:
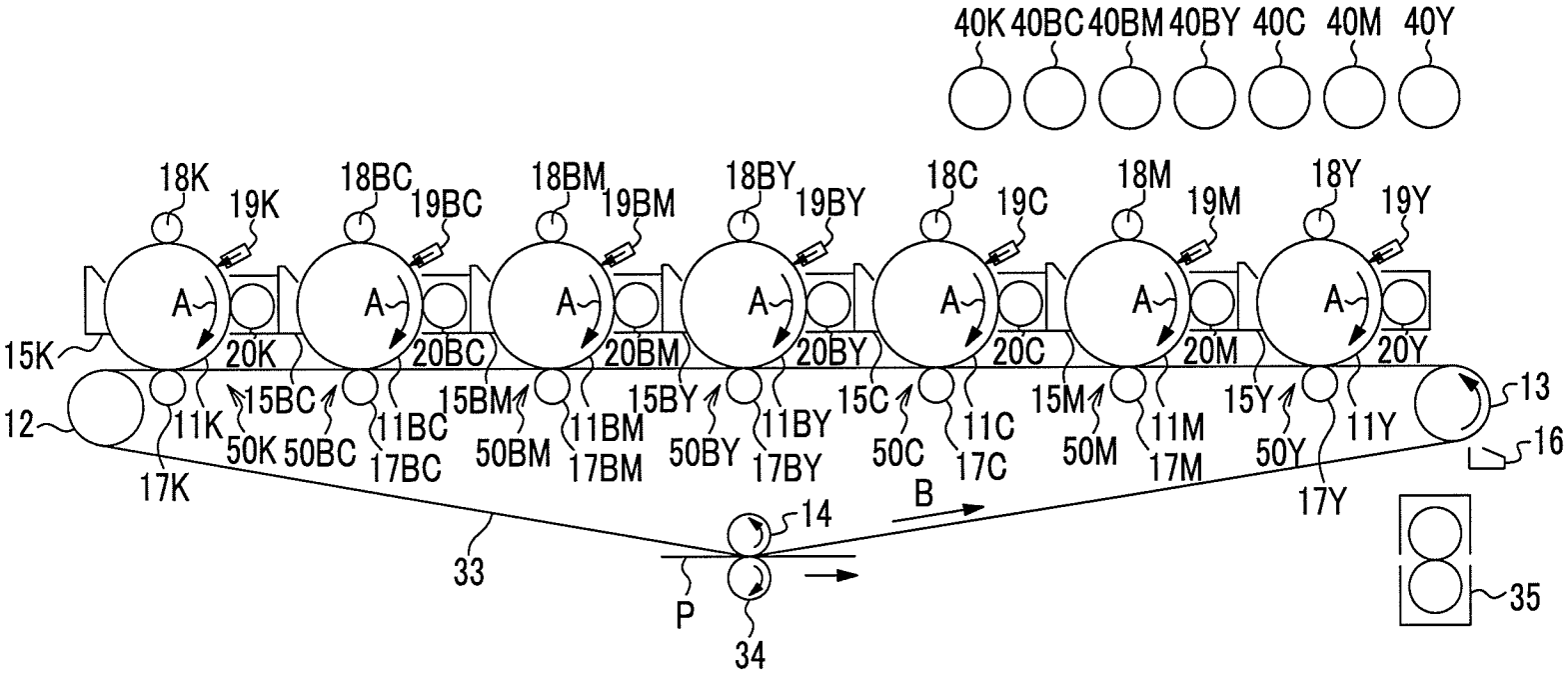
FIG. 5 is a configuration diagram schematically showing an example of an image forming apparatus according to an exemplary embodiment.

FIG. 5 is a configuration diagram schematically showing an example of the image forming apparatus according to the exemplary embodiment. The image forming apparatus according to the exemplary embodiment employs a tandem type configuration in which plural photoreceptors as a latent image holing member, that is, plural image forming units are provided.

As shown in FIG. 5, in the image forming apparatus according to the exemplary embodiment, seven image forming units 50Y, 50M, 50C, 50BY, 50BM, 50BC, and 50K that respectively form a toner image of yellow, magenta, cyan, brilliant yellow, brilliant magenta, brilliant cyan, and black are arranged in parallel (in a tandem shape) with a space therebetween. In addition, the respective image forming units are arranged in the order of the image forming units 50Y, 50M, 50C, 50BY, 50BM, 50BC, and 50K from the upstream side of the rotational direction of an intermediate transfer belt 33.

Herein, since respective image forming units 50Y, 50M, 50C, 50BY, 50BM, 50BC, and 50K have the same configuration except that the color of toners in accommodated developers is different from each other, the image forming unit 50Y that forms a yellow image will be described as a representative example. In addition, descriptions of the respective image forming units 50M, 50C, 50BY, 50BM, 50BC, and 50K are omitted by assigning referential marks of magenta (M), cyan (C), brilliant yellow (BY), brilliant magenta (BM), brilliant cyan (BC) or black (K) to a portion equivalent to the image forming unit 50Y instead of yellow (Y).

The yellow image forming unit 50Y includes a photoreceptor 11Y as a latent image holding member. The photoreceptor 11Y is driven by a driving unit (not illustrated) to rotate at a predetermined process speed along the direction of the arrow A shown in the drawing. As the photoreceptor 11Y, for example, an organic photoreceptor having sensitivity in the infrared region is used.

A charging roll (charging unit) 18Y is provided in the upper area of the photoreceptor 11Y. A predetermined voltage is applied to the charging roll 18Y by a power supply (not illustrated) and the surface of the photoreceptor 11Y is charged with a predetermined potential.

On the periphery of the photoreceptor 11Y, an exposure apparatus (electrostatic image forming unit) 19Y that exposes the surface of the photoreceptor 11Y and forms an electrostatic image is disposed on the further downstream side of the rotational direction of the photoreceptor 11Y than the charging roll 18Y. In addition, an LED array which is capable of miniaturization is used herein as the exposure apparatus 19Y from the viewpoint of an efficient use of space. However, the exposure apparatus 19Y is not limited thereto, and there is no problem in a case where other electrostatic image forming units utilizing a laser beam or the like is used.

On the periphery of the photoreceptor 11Y, a developing apparatus (developing unit) 20Y that includes a developer holding member which holds a yellow developer is disposed on the further downstream side of the rotational direction of the photoreceptor 11Y than the exposure apparatus 19Y. The developing apparatus 20Y visualizes the electrostatic image formed on the surface of the photoreceptor 11Y using a yellow toner and forms a toner image on the surface of the photoreceptor 11Y.

In the lower part of the photoreceptor 11Y, an intermediate transfer belt (primary transfer unit) 33 that performs primary transfer of the toner image formed on the surface of the photoreceptor 11Y is disposed across the lower part of the seven photoreceptors 11Y, 11M, 11C, 11BY, 11BM, 11BC, and 11K. This intermediate transfer belt 33 is pressed against the surface of the photoreceptor 11Y by a primary transfer roll 17Y. In addition, the intermediate transfer belt 33 is stretched by three rolls such as a driving roll 12, a supporting roll 13 and a bias roll 14, and is made to circumferentially move in the direction of the arrow B at a movement rate equal to the process speed of the photoreceptor 11Y. A yellow toner image is primary transferred onto the surface of the intermediate transfer belt 33. Further, the respective toner images of magenta, cyan, brilliant yellow, brilliant magenta, brilliant cyan and black are primary transferred thereon in sequence.

On the periphery of the photoreceptor 11Y, a cleaning apparatus 15Y for cleaning residual toner or retransferred toner on the surface of the photoreceptor 11Y is disposed on the further downstream side of the rotational direction (direction of the arrow A) of the photoreceptor 11Y than the primary transfer roll 17Y. The cleaning blade in the cleaning apparatus 15Y is mounted so as to come into contact under pressure with the surface of the photoreceptor 11Y in the counter direction.

A secondary transfer roll (secondary transfer unit) 34 comes into contact under pressure with the bias roll 14 stretching the intermediate transfer belt 33, with the intermediate transfer belt 33 interposed therebetween. The toner images that have been primary transferred and laminated on the surface of the intermediate transfer belt 33 are electrostatically transferred onto the surface of recording paper (recording medium) P that is supplied from a paper cassette (not illustrated), at the pressure contact area between the bias roll 14 and the secondary transfer roll 34.

A fixing machine (fixing unit) 35 for fixing the toner images that are multiple-transferred on the recording paper P to the surface of the recording paper P under heat and pressure, to make the toner images into a permanent image, is disposed downstream of the secondary transfer roll 34.

Examples of the fixing machine 35 include a fixing belt which has a belt shape by using a low-surface energy material represented by a fluororesin component or a silicone-based resin on each surface and a cylindrically shaped fixing roll by using a low-surface energy material represented by a fluororesin component or a silicone-based resin on each surface.

Next, the operations of the respective image forming units 50Y, 50M, 50C, 50BY, 50BM, 50BC, and 50K that form the respective images of yellow, magenta, cyan, brilliant yellow, brilliant magenta, brilliant cyan, and black will be described. Since the operations of the respective image forming units 50Y, 50M, 50C, 50BY, 50BM, 50BC, and 50K are the same in the respective units, the operation of the image forming unit 50Y for a yellow image will be described as a representative case.

In the yellow image forming unit 50Y, the photoreceptor 11Y rotates in the direction of the arrow A at a predetermined process speed. The surface of the photoreceptor 11Y is negatively charged by the charging roll 18Y to a predetermined potential. Thereafter, the surface of the photoreceptor 11Y is exposed by the exposure apparatus 19Y, and thereby an electrostatic image is formed in accordance with the image information. Subsequently, the toner that has been negatively charged is reverse developed by the developing apparatus 20Y, and the electrostatic image formed on the surface of the photoreceptor 11Y is converted into a visual image at the surface of the photoreceptor 11Y, so that a toner image is formed. Thereafter, the toner image on the surface of the photoreceptor 11Y is primary transferred onto the surface of the intermediate transfer belt 33 by the primary transfer roll 17Y. After the primary transfer, the photoreceptor 11Y is treated such that the transfer remnant components such as residual toner on the surface of the photoreceptor 11Y are scraped off and cleaned by the cleaning blade of the cleaning apparatus 15Y, and the photoreceptor 11Y is supplied to the next image forming step.

The operation as described above is carried out for the respective image forming units 50Y, 50M, 50C, 50BY, 50BM, 50BC, and 50K, and the toner images that have been converted into a visual image at the respective surfaces of the photoreceptors 11Y, 11M, 11C, 11BY, 11BM, 11BC, and 11K are sequentially multiple transferred onto the surface of the intermediate transfer belt 33. In the color mode, the respective toner images of different colors are multiple transferred in the order of yellow, magenta, cyan, and black, in the forming of the brilliant images, the respective toner images of different colors are multiple transferred in the order of brilliant yellow, brilliant magenta, and brilliant cyan, and also in the bicolor mode and tricolor mode, only those toner images of necessary colors are single transferred or multiple transferred in this order.

In addition, in the image forming apparatus shown in FIG. 5, the toner images are multiple transferred in the order of yellow, magenta, cyan, and black or in the order of brilliant yellow, brilliant magenta, and brilliant cyan. However, in the exemplary embodiment, by switching the positional relationship between the image forming units 50Y, 50M, 50C, 50BY, 50BM, 50BC, and 50K, the order of the multiple transfer of the toner images may be changed. Moreover, a brilliant black image forming unit may be further provided and thus the image forming apparatus may be configured to have an eight consecutive tandem configuration.

When an image of secondary color or combination color with high brilliance is obtained, a brilliant image of secondary color or combination color is formed by using the combination of brilliant yellow, brilliant magenta, and brilliant cyan. On the other hand, when an image of secondary color or combination color not exhibiting brilliance is obtained, an image of secondary color or combination color is formed by using the combination of yellow, magenta, and cyan.

Thereafter, the toner images that have been single transferred or multiple transferred onto the surface of the intermediate transfer belt 33, are secondary transferred onto the surface of the recording paper P that has been conveyed from a paper cassette (not illustrated), by the secondary transfer roll 34, and the toner images are subsequently fixed by being heated and pressed in the fixing machine 35. Any toner remaining on the surface of the intermediate transfer belt 33 after the secondary transfer is cleaned by a belt cleaner 16 composed of a cleaning blade for the intermediate transfer belt 33.

The yellow image forming unit 50Y is configured as a process cartridge in which the developing apparatus 20Y which includes a developer holding member that holds the yellow developer, the photoreceptor 11Y, the charging roll 18Y, and the cleaning apparatus 15Y are integrated, and which is detachable from the main body of the image forming apparatus. Furthermore, the image forming units 50M, 50C, 50BY, 50BM, 50BC, and 50K are also configured as process cartridges, as in the case of the image forming unit 50Y.

The toner cartridges 40Y, 40M, 40C, 40BY, 40BM, 40BC, and 40K are cartridges which accommodate the toners of the respective colors, and are detachable from the image forming apparatus. Each toner cartridge is connected to the corresponding developing apparatus for each color, via a toner supply pipe that is not illustrated in the drawing. When the amount of the toner accommodated in each toner cartridge decreases, a replacement of this toner cartridge is made.

EXAMPLES

The present exemplary embodiment will be described below in more detail based on examples and comparative examples, but the present exemplary embodiment is not limited to the following examples. In addition, "part(s)" and "%" represent "part(s) by weight" and "% by weight" unless otherwise specified.

Method of Measuring Content of Pigment to Resin in Toner

The content of the pigments (brilliant pigment and colorant) with respect to the resin in the toner is measured by the following method. About 10 mg of the toner is accurately measured by using TGA-60AH (manufactured by Shimadzu Corporation). The reason why about 10 mg of the toner is used is that about 10 mg is a proper amount as a sample of the TGA. This is not problematic as long as the amount thereof is accurate (specifically, down to 0.1 mg). The toner is heated at 10° C./min and the temperature thereof is raised to 800° C. Volatile matter content of moisture and the like is degraded by the time when the temperature reaches 100° C., and thereafter, the release agent, the binder resin, and the colorant are degraded in this order and then this causes change in weight, and the brilliant pigment is not degraded eventually, the content of the pigments are measured from the change in weight.

For example, if, in the 10.2 mg of the toner, the change in weight of the release agent is 1.0 mg, the change in weight of the resin is 5.9 mg, the change in weight of the colorant is 1.2 mg, and the remnant component (brilliant pigment) is 2.1 mg, the content of the brilliant pigment may be calculated from the ratio of the brilliant pigment to the resin, that is, 2.1/5.9=0.36 (36%) and the content of the colorant may be calculated from the ratio of the colorant to the resin, that is, 1.2/5.9=0.20 (20%).

Synthesis of Binder Resin

| | |
|---|---|
| Dimethyl adipate: | 74 parts |
| Dimethyl terephthalate: | 192 parts |
| Bisphenol A ethylene oxide adduct: | 216 parts |
| Ethylene glycol: | 38 parts |
| Tetrabutoxytitanate (catalyst): | 0.037 part |

The above components are put in a two-neck flask dried by heating, nitrogen gas is put into the container to maintain an inert gas atmosphere, and the temperature is raised while stirring. Thereafter, a copolycondensation reaction is caused at 160° C. for 7 hours, and then the temperature is raised to 220° C. while the pressure is slowly reduced to 10 Torr, and the temperature is held for 4 hours. The pressure is temporarily returned to normal pressure, and then 9 parts of trimellitic anhydride is added. The pressure is then slowly reduced again to 10 Torr, and the temperature is held at 220° C. for an hour, thereby synthesizing binder resin.

Preparation of Binder Resin Dispersion

| | |
|---|---|
| Binder resin: | 160 parts |
| Ethyl acetate: | 233 parts |
| Aqueous sodium hydroxide solution (0.3N): | 0.1 part |

The above components are put in a 1000 ml separable flask, followed by heating at 70° C., and the resultant is stirred with a Three-One motor (manufactured by Shinto Scientific Co., Ltd.), thereby preparing a resin mixture solution. While this resin mixture solution is further stirred, 373 parts of ion exchange water is gradually added thereto to cause phase inversion emulsification, and the solvent is removed, thereby obtaining a binder resin dispersion (solid content concentration: 300).

Preparation of Brilliant Pigment Dispersion

| | |
|---|---|
| Aluminum pigment (manufactured by SHOWA ALUMINUM POWDER K.K., 2173EA, 6 μm): | 100 parts |
| Anionic surfactant (manufactured by DAI-ICHI KOGYO SEIYAKU CO., LTD., NEOGEN R): | 1.5 parts |
| Ion exchange water: | 400 parts |

A solvent is removed from a paste of the aluminum pigment and the pigment is mechanically pulverized to 5.2 μm using Star Mill (manufactured by Ashizawa Finetech Ltd., LMZ) and classified. Thereafter, the resultant is mixed with the surfactant and the ion exchange water and then the obtained mixture is dispersed using an emulsification dispersing machine CAVITRON (manufactured by Pacific Machinery & Engineering Co., Ltd., CR 1010) for about 1 hour. As a result, a brilliant pigment dispersion, in which brilliant pigment particles (aluminum pigment particles) are dispersed, is prepared (solid content concentration: 20%). The dispersion diameter of the pigment is 5.2 μm.

Preparation of Yellow Colorant Dispersion

| | |
|---|---|
| C. I. Pigment Yellow 74 (manufactured by Dainichiseika Color Chemicals Mfg. Co., Ltd.): | 50 parts |
| Ionic surfactant NEOGEN RK (manufactured by DAI-ICHI KOGYO SEIYAKU CO., LTD.): | 5 parts |
| Ion exchange water: | 192.9 parts |

The above components are mixed and subjected to a process at 240 MPa for 10 minutes by Ultimizer (manufactured by Sugino Machine, Ltd.), thereby obtaining a yellow colorant dispersion (solid content concentration: 20%).

Preparation of Cyan Colorant Dispersion

A cyan colorant dispersion is prepared in the same manner as in the preparation of the yellow colorant dispersion, except that the colorant is changed from C. I. Pigment Yellow 74 to C. I. Pigment Blue 15:3 (copper phthalocyanine, manufactured by Dainichiseika Color & Chemicals Mfg. Co., Ltd.). The solid content concentration thereof is 20%.

Preparation of Magenta Colorant Dispersion

A magenta colorant dispersion is prepared in the same manner as in the preparation of the yellow colorant dispersion, except that the colorant is changed from C. I. Pigment Yellow 74 to C. I. Pigment Red 122 (quinacridone, manufactured by Dainichiseika Color & Chemicals Mfg. Co., Ltd.). The solid content concentration thereof is 20%.

Preparation of Release Agent Dispersion 1

| | |
|---|---|
| Carnauba wax (manufactured by TOA KASEI CO., LTD., RC-160): | 50 parts |
| Anionic surfactant (manufactured by DAI-ICHI KOGYO SEIYAKU CO., LTD., NEOGEN RK): | 1.0 part |
| Ion exchange water: | 200 parts |

The above components are mixed and heated to 95° C., and dispersed using a homogenizer (manufactured by IKA, Ultra Turrax T50). Thereafter, the resultant is dispersed for 360 minutes by using a Manton-Gaulin high pressure homogenizer (manufactured by Gaulin Corporation), thereby preparing a release agent dispersion 1 (solid content concentration: 20%) in which release agent particles having a volume average particle diameter of 0.23 μm are dispersed.

Preparation of Release Agent Dispersion 2

A release agent dispersion 2 (solid content concentration: 20%) is prepared in the same manner as in the preparation of the release agent dispersion 1, except that polyethylene wax (manufactured by Baker Petrolite, Polywax 725) is used instead of the carnauba wax.

Preparation of Brilliant Yellow Toner 1

| | |
|---|---|
| Binder resin dispersion: | 480 parts |
| Release agent dispersion 1: | 72 parts |
| Brilliant Pigment Dispersion: | 140 parts |
| Yellow colorant dispersion: | 40 parts |
| Nonionic surfactant (IGEPAL CA 897): | 1.40 parts |

The above raw materials are put into a 2 L cylindrical stainless steel container, followed by dispersion and mixing for 10 minutes with a homogenizer (manufactured by IKA, ULTRA-TURRAX T50) while applying a shearing force at 4000 rpm. Next, 1.75 parts of 10% nitric acid aqueous solution of polyaluminum chloride as a coagulant is gradually added dropwise, followed by dispersion and mixing with the homogenizer at 5000 rpm for 15 minutes. As a result, a raw material dispersion is obtained.

Thereafter, the raw material dispersion is put into a polymerization kettle which includes a stirring device using a two-paddle stirring blade for generating a laminar flow and a thermometer, followed by heating with a mantle heater under stirring at 810 rpm to promote the growth of aggregated particles at 54° C. At this time, the pH value of the raw material dispersion is adjusted to a range of 2.2 to 3.5 using 0.3 N nitric acid and 1 N sodium hydroxide aqueous solution. The resultant is held in the above-described pH value range for about 2 hours and aggregated particles are formed.

Next, 100 parts of the binder resin dispersion is further added thereto so that the resin particles of the binder resin are allowed to adhere to the surfaces of the aggregated particles. The temperature is further raised to 56° C., and the aggregated particles are adjusted while observing the particle diameter of the particles with an optical microscope and a MULTISIZER II. Subsequently, in order to cause the aggregated particles to coalesce, the pH value is increased to 8.0 and then the temperature is raised to 67.5° C. After the coalescence of the aggregated particles is confirmed with the optical microscope, the pH value is decreased to 6.0 while maintaining the temperature at 67.5° C. After 1 hour, heating is stopped and cooling is performed at a temperature decreasing rate of 1.0° C./min. The particles are then sieved through a 20 mesh, repeatedly washed with water, and then dried in a vacuum dryer. As a result, toner particles are obtained. The obtained toner particles have a volume average particle diameter of 12.2 μm.

1.5 parts of hydrophobic silica (manufactured by Nippon Aerosil Co., Ltd., RY50) is mixed with 100 parts of the obtained toner particles using a Henschel mixer at a circumferential speed of 33 m/sec for 3 minutes. Thereafter, the resultant is sieved with a vibration sieve having an aperture of 45 and a brilliant yellow toner 1 is prepared.

Preparation of Carrier

| | |
|---|---|
| Toluene: | 14 parts |
| Styrene-methyl methacrylate copolymer (component ratio: 80/20, weight average molecular weight: 70,000): | 2 part |
| MZ500 (zinc oxide, manufactured by Titan Kogyo, Ltd.): | 0.6 part |

The above components are mixed and stirred with a stirrer for 10 minutes, thereby preparing a coating layer-forming solution in which zinc oxide is dispersed. Then, the coating layer-forming solution and 100 parts of ferrite particles (volume average particle diameter: 38 μm) are put into a vacuum degassing kneader, followed by stirring at 60° C. for 30 minutes. Thereafter, the pressure is reduced while further warming, and degassing and drying are performed, thereby preparing a carrier.

Preparation of Brilliant Yellow Developer 1

100 parts of the obtained carrier and 8 parts of the brilliant yellow toner 1 are mixed by using a 2 liter V blender, thereby preparing a brilliant yellow developer 1.

Preparation of Brilliant Cyan Toner 1

A brilliant cyan toner 1 is prepared in the same manner as in the preparation of the brilliant yellow toner 1, except that the yellow colorant dispersion is changed to the cyan colorant dispersion. A brilliant cyan developer 1 is prepared by using the obtained brilliant cyan toner 1 in a manner similar to that of the brilliant yellow developer 1.

Preparation of Brilliant Magenta Toner 1

A brilliant magenta toner 1 is prepared in the same manner as in the preparation of the brilliant yellow toner 1, except that the yellow colorant dispersion is changed to the magenta colorant dispersion. A brilliant magenta developer 1 is prepared by using the obtained brilliant magenta toner 1 in a manner similar to that of the brilliant yellow developer 1.

Preparation of Brilliant Yellow Toner 2

| | |
|---|---|
| Binder resin dispersion: | 541 parts |
| Release agent dispersion 1: | 72 parts |
| Brilliant pigment dispersion: | 39 parts |
| Yellow colorant dispersion: | 48.7 parts |
| Nonionic surfactant (IGEPAL CA 897): | 1.40 parts |

A brilliant yellow toner 2 is prepared in the same manner as in the preparation of the brilliant yellow toner 1, except that the above components are used. A brilliant yellow developer 2 is prepared by using the obtained brilliant yellow toner 2 in a manner similar to that of the brilliant yellow developer 1.

Preparation of Brilliant Cyan Toner 2

A brilliant cyan toner 2 is prepared in the same manner as in the preparation of the brilliant yellow toner 2, except that the yellow colorant dispersion is changed to the cyan colorant dispersion. A brilliant cyan developer 2 is prepared by using the obtained brilliant cyan toner 2 in a manner similar to that of the brilliant yellow developer 2.

Preparation of Brilliant Magenta Toner 2

A brilliant magenta toner 2 is prepared in the same manner as in the preparation of the brilliant yellow toner 2, except that the yellow colorant dispersion is changed to the magenta colorant dispersion. A brilliant magenta developer 2 is prepared by using the obtained brilliant magenta toner 2 in a manner similar to that of the brilliant yellow developer 2.

Preparation of Brilliant Yellow Toner 3

| | |
|---|---|
| Binder resin dispersion: | 539.6 parts |
| Release agent dispersion 1: | 90 parts |
| Brilliant pigment dispersion: | 42.1 parts |
| Yellow colorant dispersion: | 48.7 parts |
| Nonionic surfactant (IGEPAL CA 897): | 1.40 parts |

A brilliant yellow toner 3 is prepared in the same manner as in the preparation of the brilliant yellow toner 1, except that the above components are used. A brilliant yellow developer 3 is prepared by using the obtained brilliant yellow toner 3 in a manner similar to that of the brilliant yellow developer 1.

Preparation of Brilliant Cyan Toner 3

A brilliant cyan toner 3 is prepared in the same manner as in the preparation of the brilliant yellow toner 3, except that the yellow colorant dispersion is changed to the cyan colorant dispersion. A brilliant cyan developer 3 is prepared by using the obtained brilliant cyan toner 3 in a manner similar to that of the brilliant yellow developer 3.

Preparation of Brilliant Magenta Toner 3

A brilliant magenta toner 3 is prepared in the same manner as in the preparation of the brilliant yellow toner 3, except that the yellow colorant dispersion is changed to the magenta colorant dispersion. A brilliant magenta developer 3 is prepared by using the obtained brilliant magenta toner 3 in a manner similar to that of the brilliant yellow developer 3.

Preparation of Brilliant Yellow Toner 4

| | |
|---|---|
| Binder resin dispersion: | 387.1 parts |
| Release agent dispersion 1: | 85 parts |
| Brilliant pigment dispersion: | 284.5 parts |
| Yellow colorant dispersion: | 34.8 parts |
| Nonionic surfactant (IGEPAL CA 897): | 1.40 parts |

A brilliant yellow toner 4 is prepared in the same manner as in the preparation of the brilliant yellow toner 1, except that the above components are used. A brilliant yellow developer 4 is prepared by using the obtained brilliant yellow toner 4 in a manner similar to that of the brilliant yellow developer 1.

Preparation of Brilliant Cyan Toner 4

A brilliant cyan toner 4 is prepared in the same manner as in the preparation of the brilliant yellow toner 4, except that the yellow colorant dispersion is changed to the cyan colorant dispersion. A brilliant cyan developer 4 is prepared by using the obtained brilliant cyan toner 4 in a manner similar to that of the brilliant yellow developer 4.

Preparation of Brilliant Magenta Toner 4

A brilliant magenta toner 4 is prepared in the same manner as in the preparation of the brilliant yellow toner 4, except that the yellow colorant dispersion is changed to the magenta colorant dispersion. A brilliant magenta developer 4 is prepared by using the obtained brilliant magenta toner 4 in a manner similar to that of the brilliant yellow developer 4.

Preparation of Brilliant Yellow Toner 5

| | |
|---|---|
| Binder resin dispersion: | 382.2 parts |
| Release agent dispersion 1: | 72 parts |
| Brilliant pigment dispersion: | 292.4 parts |
| Yellow colorant dispersion: | 34.4 parts |
| Nonionic surfactant (IGEPAL CA 897): | 1.40 parts |

A brilliant yellow toner 5 is prepared in the same manner as in the preparation of the brilliant yellow toner 1, except that the above components are used. A brilliant yellow developer 5 is prepared by using the obtained brilliant yellow toner 5 in a manner similar to that of the brilliant yellow developer 1.

Preparation of Brilliant Cyan Toner 5

A brilliant cyan toner 5 is prepared in the same manner as in the preparation of the brilliant yellow toner 5, except that the yellow colorant dispersion is changed to the cyan colorant dispersion. A brilliant cyan developer 5 is prepared by using the obtained brilliant cyan toner 5 in a manner similar to that of the brilliant yellow developer 5.

Preparation of Brilliant Magenta Toner 5

A brilliant magenta toner 5 is prepared in the same manner as in the preparation of the brilliant yellow toner 5, except that the yellow colorant dispersion is changed to the magenta colorant dispersion. A brilliant magenta developer 5 is prepared by using the obtained brilliant magenta toner 5 in a manner similar to that of the brilliant yellow developer 5.

Preparation of Brilliant Yellow Toner 6

| | |
|---|---|
| Binder resin dispersion: | 503.8 parts |
| Release agent dispersion 1: | 72 parts |
| Brilliant pigment dispersion: | 143.6 parts |
| Yellow colorant dispersion: | 0.7 parts |
| Nonionic surfactant (IGEPAL CA 897): | 1.40 parts |

A brilliant yellow toner 6 is prepared in the same manner as in the preparation of the brilliant yellow toner 1, except that the above components are used. A brilliant yellow developer 6 is prepared by using the obtained brilliant yellow toner 6 in a manner similar to that of the brilliant yellow developer 1.

Preparation of Brilliant Cyan Toner 6

A brilliant cyan toner 6 is prepared in the same manner as in the preparation of the brilliant yellow toner 6, except that the yellow colorant dispersion is changed to the cyan colorant dispersion. A brilliant cyan developer 6 is prepared by using the obtained brilliant cyan toner 6 in a manner similar to that of the brilliant yellow developer 6.

Preparation of Brilliant Magenta Toner 6

A brilliant magenta toner 6 is prepared in the same manner as in the preparation of the brilliant yellow toner 6, except that the yellow colorant dispersion is changed to the magenta colorant dispersion. A brilliant magenta developer 6 is prepared by using the obtained brilliant magenta toner 6 in a manner similar to that of the brilliant yellow developer 6.

Preparation of Brilliant Yellow Toner 7

| | |
|---|---|
| Binder resin dispersion: | 503.7 parts |
| Release agent dispersion 1: | 72 parts |
| Brilliant pigment dispersion: | 143.6 parts |
| Yellow colorant dispersion: | 0.8 part |
| Nonionic surfactant (IGEPAL CA 897): | 1.40 parts |

A brilliant yellow toner 7 is prepared in the same manner as in the preparation of the brilliant yellow toner 1, except that the above components are used. A brilliant yellow developer 7 is prepared by using the obtained brilliant yellow toner 7 in a manner similar to that of the brilliant yellow developer 1.

Preparation of Brilliant Cyan Toner 7

A brilliant cyan toner 7 is prepared in the same manner as in the preparation of the brilliant yellow toner 7, except that the yellow colorant dispersion is changed to the cyan colorant dispersion. A brilliant cyan developer 7 is prepared by using the obtained brilliant cyan toner 7 in a manner similar to that of the brilliant yellow developer 7.

Preparation of Brilliant Magenta Toner 7

A brilliant magenta toner 7 is prepared in the same manner as in the preparation of the brilliant yellow toner 7, except that the yellow colorant dispersion is changed to the magenta colorant dispersion. A brilliant magenta developer 7 is prepared by using the obtained brilliant magenta toner 7 in a manner similar to that of the brilliant yellow developer 7.

Preparation of Brilliant Yellow Toner 8

| | |
|---|---|
| Binder resin dispersion: | 502.2 parts |
| Release agent dispersion 1: | 72 parts |
| Brilliant pigment dispersion: | 143.1 parts |
| Yellow colorant dispersion: | 3.6 parts |
| Nonionic surfactant (IGEPAL CA 897): | 1.40 parts |

A brilliant yellow toner 8 is prepared in the same manner as in the preparation of the brilliant yellow toner 1, except that the above components are used. A brilliant yellow developer 8 is prepared by using the obtained brilliant yellow toner 8 in a manner similar to that of the brilliant yellow developer 1.

Preparation of Brilliant Cyan Toner 8

A brilliant cyan toner 8 is prepared in the same manner as in the preparation of the brilliant yellow toner 8, except that the yellow colorant dispersion is changed to the cyan colorant dispersion. A brilliant cyan developer 8 is prepared by using the obtained brilliant cyan toner 8 in a manner similar to that of the brilliant yellow developer 8.

Preparation of Brilliant Magenta Toner 8

A brilliant magenta toner 8 is prepared in the same manner as in the preparation of the brilliant yellow toner 8, except that the yellow colorant dispersion is changed to the magenta colorant dispersion. A brilliant magenta developer 8 is prepared by using the obtained brilliant magenta toner 8 in a manner similar to that of the brilliant yellow developer 8.

Preparation of Brilliant Yellow Toner 9

| | |
|---|---|
| Binder resin dispersion: | 502.0 parts |
| Release agent dispersion 1: | 72 parts |
| Brilliant pigment dispersion: | 143.0 parts |
| Yellow colorant dispersion: | 4.0 parts |
| Nonionic surfactant (IGEPAL CA 897): | 1.40 parts |

A brilliant yellow toner 9 is prepared in the same manner as in the preparation of the brilliant yellow toner 1, except that the above components are used. A brilliant yellow developer 9 is prepared by using the obtained brilliant yellow toner 9 in a manner similar to that of the brilliant yellow developer 1.

Preparation of Brilliant Cyan Toner 9

A brilliant cyan toner 9 is prepared in the same manner as in the preparation of the brilliant yellow toner 9, except that the yellow colorant dispersion is changed to the cyan colorant dispersion. A brilliant cyan developer 9 is prepared by using the obtained brilliant cyan toner 9 in a manner similar to that of the brilliant yellow developer 9.

Preparation of Brilliant Magenta Toner 9

A brilliant magenta toner 9 is prepared in the same manner as in the preparation of the brilliant yellow toner 9, except that the yellow colorant dispersion is changed to the magenta colorant dispersion. A brilliant magenta developer 9 is prepared by using the obtained brilliant magenta toner 9 in a manner similar to that of the brilliant yellow developer 9.

Preparation of Brilliant Yellow Toner 10

| | |
|---|---|
| Binder resin dispersion: | 473.2 parts |
| Release agent dispersion 1: | 72 parts |
| Brilliant pigment dispersion: | 134.9 parts |
| Yellow colorant dispersion: | 55.4 parts |
| Nonionic surfactant (IGEPAL CA 897): | 1.40 parts |

A brilliant yellow toner 10 is prepared in the same manner as in the preparation of the brilliant yellow toner 1, except that the above components are used. A brilliant yellow developer 10 is prepared by using the obtained brilliant yellow toner 10 in a manner similar to that of the brilliant yellow developer 1.

Preparation of Brilliant Cyan Toner 10

A brilliant cyan toner 10 is prepared in the same manner as in the preparation of the brilliant yellow toner 10, except that the yellow colorant dispersion is changed to the cyan colorant dispersion. A brilliant cyan developer 10 is prepared by using the obtained brilliant cyan toner 10 in a manner similar to that of the brilliant yellow developer 10.

Preparation of Brilliant Magenta Toner 10

A brilliant magenta toner 10 is prepared in the same manner as in the preparation of the brilliant yellow toner 10, except that the yellow colorant dispersion is changed to the magenta colorant dispersion. A brilliant magenta developer 10 is prepared by using the obtained brilliant magenta toner 10 in a manner similar to that of the brilliant yellow developer 10.

Preparation of Brilliant Yellow Toner 11

| | |
|---|---|
| Binder resin dispersion: | 471.7 parts |
| Release agent dispersion 1: | 72 parts |
| Brilliant pigment dispersion: | 134.4 parts |
| Yellow colorant dispersion: | 58.0 parts |
| Nonionic surfactant (IGEPAL CA 897): | 1.40 parts |

A brilliant yellow toner 11 is prepared in the same manner as in the preparation of the brilliant yellow toner 1, except that the above components are used. A brilliant yellow developer 11 is prepared by using the obtained brilliant yellow toner 11 in a manner similar to that of the brilliant yellow developer 1.

Preparation of Brilliant Cyan Toner 11

A brilliant cyan toner 11 is prepared in the same manner as in the preparation of the brilliant yellow toner 11, except that the yellow colorant dispersion is changed to the cyan colorant dispersion. A brilliant cyan developer 11 is prepared by using the obtained brilliant cyan toner 11 in a manner similar to that of the brilliant yellow developer 11.

Preparation of Brilliant Magenta Toner 11

A brilliant magenta toner 11 is prepared in the same manner as in the preparation of the brilliant yellow toner 11, except that the yellow colorant dispersion is changed to the magenta colorant dispersion. A brilliant magenta developer 11 is prepared by using the obtained brilliant magenta toner 11 in a manner similar to that of the brilliant yellow developer 11.

Preparation of Brilliant Yellow Toner 12

| | |
|---|---|
| Binder resin dispersion: | 466.2 parts |
| Release agent dispersion 1: | 72 parts |
| Brilliant pigment dispersion: | 132.9 parts |
| Yellow colorant dispersion: | 67.8 parts |
| Nonionic surfactant (IGEPAL CA 897): | 1.40 parts |

A brilliant yellow toner 12 is prepared in the same manner as in the preparation of the brilliant yellow toner 1, except that the above components are used. A brilliant yellow developer 12 is prepared by using the obtained brilliant yellow toner 12 in a manner similar to that of the brilliant yellow developer 1.

Preparation of Brilliant Cyan Toner 12

A brilliant cyan toner 12 is prepared in the same manner as in the preparation of the brilliant yellow toner 12, except that the yellow colorant dispersion is changed to the cyan colorant dispersion. A brilliant cyan developer 12 is prepared by using the obtained brilliant cyan toner 12 in a manner similar to that of the brilliant yellow developer 12.

Preparation of Brilliant Magenta Toner 12

A brilliant magenta toner 12 is prepared in the same manner as in the preparation of the brilliant yellow toner 12, except that the yellow colorant dispersion is changed to the magenta colorant dispersion. A brilliant magenta developer 12 is prepared by using the obtained brilliant magenta toner 12 in a manner similar to that of the brilliant yellow developer 12.

Preparation of Brilliant Yellow Toner 13

| | |
|---|---|
| Binder resin dispersion: | 464.4 parts |
| Release agent dispersion 1: | 72 parts |
| Brilliant pigment dispersion: | 132.4 parts |
| Yellow colorant dispersion: | 71.1 parts |
| Nonionic surfactant (IGEPAL CA 897): | 1.40 parts |

A brilliant yellow toner 13 is prepared in the same manner as in the preparation of the brilliant yellow toner 1, except that the above components are used. A brilliant yellow developer 13 is prepared by using the obtained brilliant yellow toner 13 in a manner similar to that of the brilliant yellow developer 1.

Preparation of Brilliant Cyan Toner 13

A brilliant cyan toner 13 is prepared in the same manner as in the preparation of the brilliant yellow toner 13, except that the yellow colorant dispersion is changed to the cyan colorant dispersion. A brilliant cyan developer 13 is prepared by using the obtained brilliant cyan toner 13 in a manner similar to that of the brilliant yellow developer 13.

Preparation of Brilliant Magenta Toner 13

A brilliant magenta toner 13 is prepared in the same manner as in the preparation of the brilliant yellow toner 13, except that the yellow colorant dispersion is changed to the magenta colorant dispersion. A brilliant magenta developer 13 is prepared by using the obtained brilliant magenta toner 13 in a manner similar to that of the brilliant yellow developer 13.

Preparation of Brilliant Yellow Toner 14

A brilliant yellow toner 14 is prepared in the same manner as in the preparation of the brilliant yellow toner 1, except that the release agent dispersion 2 is used instead of the release agent dispersion 1. A brilliant yellow developer 14 is prepared by using the obtained brilliant yellow toner 14 in a manner similar to that of the brilliant yellow developer 1.

Preparation of Brilliant Cyan Toner 14

A brilliant cyan toner 14 is prepared in the same manner as in the preparation of the brilliant yellow toner 14, except that the yellow colorant dispersion is changed to the cyan colorant dispersion. A brilliant cyan developer 14 is prepared by using the obtained brilliant cyan toner 14 in a manner similar to that of the brilliant yellow developer 14.

Preparation of Brilliant Magenta Toner 14

A brilliant magenta toner 14 is prepared in the same manner as in the preparation of the brilliant yellow toner 14, except that the yellow colorant dispersion is changed to the magenta colorant dispersion. A brilliant magenta developer 14 is prepared by using the obtained brilliant magenta toner 14 in a manner similar to that of the brilliant yellow developer 14.

For the brilliant yellow toners 1 to 14, the brilliant cyan toners 1 to 14, and the brilliant magenta toners 1 to 14, the content of the brilliant pigments (content ratio of the brilliant pigments with respect to the binder resin) and the content of the colorants (content ratio of the colorants other than the brilliant pigment with respect to the binder resin) are shown in Table 1.

TABLE 1

| Toner | Content of Brilliant Pigment | Content of Colorant |
|---|---|---|
| Brilliant Yellow Toner 1 | 19.0% | 5.6% |
| Brilliant Yellow Toner 2 | 4.8% | 6.1% |
| Brilliant Yellow Toner 3 | 5.2% | 6.0% |
| Brilliant Yellow Toner 4 | 49% | 6.2% |
| Brilliant Yellow Toner 5 | 51% | 6.0% |
| Brilliant Yellow Toner 6 | 19.0% | 0.09% |
| Brilliant Yellow Toner 7 | 19.1% | 0.11% |
| Brilliant Yellow Toner 8 | 19.0% | 0.48% |
| Brilliant Yellow Toner 9 | 18.9% | 0.53% |
| Brilliant Yellow Toner 10 | 19.1% | 7.8% |
| Brilliant Yellow Toner 11 | 19.0% | 8.2% |
| Brilliant Yellow Toner 12 | 19.1% | 9.7% |
| Brilliant Yellow Toner 13 | 19.0% | 10.2% |
| Brilliant Yellow Toner 14 | 19.1% | 5.6% |
| Brilliant Cyan Toner 1 | 19.1% | 5.7% |
| Brilliant Cyan Toner 2 | 4.9% | 6.2% |
| Brilliant Cyan Toner 3 | 5.1% | 6.1% |
| Brilliant Cyan Toner 4 | 49% | 6.0% |
| Brilliant Cyan Toner 5 | 52% | 6.0% |
| Brilliant Cyan Toner 6 | 19.1% | 0.09% |
| Brilliant Cyan Toner 7 | 18.8% | 0.11% |
| Brilliant Cyan Toner 8 | 19.1% | 0.47% |
| Brilliant Cyan Toner 9 | 18.8% | 0.52% |
| Brilliant Cyan Toner 10 | 19.2% | 7.7% |
| Brilliant Cyan Toner 11 | 19.1% | 8.2% |
| Brilliant Cyan Toner 12 | 19.1% | 9.8% |
| Brilliant Cyan Toner 13 | 19.2% | 10.2% |
| Brilliant Cyan Toner 14 | 19.1% | 5.6% |
| Brilliant Magenta Toner 1 | 19.0% | 5.6% |
| Brilliant Magenta Toner 2 | 4.8% | 6.1% |
| Brilliant Magenta Toner 3 | 5.3% | 6.2% |
| Brilliant Magenta Toner 4 | 48% | 6.1% |
| Brilliant Magenta Toner 5 | 51% | 6.1% |
| Brilliant Magenta Toner 6 | 19.1% | 0.09% |
| Brilliant Magenta Toner 7 | 19.0% | 0.11% |
| Brilliant Magenta Toner 8 | 19.0% | 0.48% |
| Brilliant Magenta Toner 9 | 18.8% | 0.53% |
| Brilliant Magenta Toner 10 | 19.1% | 7.8% |
| Brilliant Magenta Toner 11 | 18.9% | 8.2% |
| Brilliant Magenta Toner 12 | 19.2% | 9.7% |
| Brilliant Magenta Toner 13 | 19.0% | 10.2% |
| Brilliant Magenta Toner 14 | 19.1% | 5.6% |

Preparation of Brilliant Silver Toner

A brilliant silver toner is prepared in the same manner as in the preparation of the brilliant yellow toner 1, except that the yellow colorant dispersion is not used. A brilliant silver developer is prepared by using the obtained brilliant silver toner in a manner similar to that of the brilliant yellow developer 1.

Preparation of Yellow Toner

| | |
|---|---|
| Binder resin dispersion: | 400 parts |
| Yellow colorant dispersion: | 35 parts |

-continued

| | |
|---|---|
| Release agent dispersion 1: | 80 parts |
| Anionic surfactant (manufactured by DAI-ICHI KOGYO SEIYAKU CO., LTD., NEOGEN RK): | 1.30 parts |

The above raw materials are put into a 2 L cylindrical stainless steel container, followed by dispersion and mixing for 10 minutes with a homogenizer (manufactured by IKA, ULTRA-TURRAX T50) while applying a shearing force at 4000 rpm. Next, 0.14 part of 10% nitric acid aqueous solution of polyaluminum chloride as a coagulant is started to be added dropwise and then the pre-aggregation is promoted.

Subsequently, the raw material dispersion is put into a polymerization kettle which includes a stirring device and a thermometer, followed by heating with a mantle heater while maintaining the temperature at 52° C. for 2 hours to promote the growth of aggregated particles. Thereafter, 190 parts of the binder resin dispersion is further added thereto so that the resin particles of the binder resin are allowed to adhere to the surfaces of the aggregated particles. The aggregated particles are adjusted while observing the particle diameter of the particles with an optical microscope and a MULTISIZER II.

Subsequently, in order to cause the aggregated particles to coalesce, the pH value is increased to 8.5 and then the temperature is raised to 90° C. After the temperature is raised, the temperature is maintained at 90° C. for 3 hours. Then, after the coalescence of the aggregated particles is confirmed with the microscope, the pH value is decreased again to 6.5 while maintaining the temperature at 90° C. After 1 hour, heating is stopped and the resultant is allowed to cool. The particles are then sieved through a 20 μm mesh, repeatedly washed with water, and then dried in a vacuum dryer. The granulated toner particles as described above have a volume average particle diameter of 7.3 μm.

1.5 parts of hydrophobic silica (manufactured by Nippon Aerosil Co., Ltd., RY50) is blended with 100 parts of the obtained toner particles using a sample mill at 10,000 rpm for 30 seconds. Thereafter, the resultant is sieved with a vibration sieve having an aperture of 45 μm and a yellow toner is prepared.

Preparation of Yellow Developer 100 parts of the carrier and 8 parts of the yellow toner are mixed by using a 2 liter V blender, thereby preparing a yellow developer.

Preparation of Cyan Toner

A cyan toner is prepared in the same manner as in the preparation of the yellow toner, except that the yellow colorant dispersion is changed to the cyan colorant dispersion. A cyan developer is prepared by using the obtained cyan toner in a manner similar to that of the yellow developer.

Preparation of Magenta Toner

A magenta toner is prepared in the same manner as in the preparation of the yellow toner, except that the yellow colorant dispersion is changed to the magenta colorant dispersion. A magenta developer is prepared by using the obtained magenta toner in a manner similar to that of the yellow developer.

Example 1

The brilliant yellow developer 1, the brilliant cyan developer 1, and the brilliant magenta developer 1 are filled with a developer unit of a DocuCentre-III C7600 manufactured by Fuji Xerox Co., Ltd., and an image is outputted on a sheet of recording paper (OK Topcoat+Paper manufactured by Oji Paper Co., Ltd.) by using a DocuCentre-III C7600 modified device (the modified device which is capable of outputting without a developer in a black developer unit) in an unfixed state. Next, the unfixed image is fixed at a fixing temperature of 190° C. At this time, a fixing pressure is 4.0 kg/cm$^2$, and a speed thereof 160 mm/s. In addition, for images of the deepest colors in blue, green, and red portions in a color gradation patch portion, by using Test Chart No. 5-1 of Electrophotographic Institute (the Imaging Society of Japan), the brilliance of the obtained solid image is obtained by the following method. The results are shown in Table 2.

Evaluation of Brilliance

The brilliance is evaluated by visual observation under illumination for observing colors (natural daylight illumination) in accordance with "Testing methods for paints, Part 4: Visual characteristics of film, Section 3: Visual comparison of the color of paints" specified in JIS K5600-4-3:1999. A particle feeling (a shiny effect of the brilliance) and an optical effect (a change in the hue depending on the angle of view) are evaluated by the criterion described below. In the criterion, 2 or more is a level of practical use.

5: The particle feeling and the optical effect are harmonized.

4: The particle feeling and the optical effect are somewhat observed.

3: The image has a normal appearance.

2: The image has a little blurred appearance.

1: No particle feeling and optical effect is observed.

Examples 2 to 14

The developer as shown in Table 2 is evaluated on the same method as that of Example 1 and then the brilliance is evaluated. The results are shown in Table 2.

Comparative Example 1

An unfixed image is prepared by using the yellow developer, the cyan developer, the magenta developer, and the brilliant silver developer in a similar manner to that of Example 1 and then a fixed image is obtained by using the same fixing device as in Example 1. In addition, the silver developer is put into the black developer unit and all silver color images are developed to be solid images. By doing so, the respective images of the yellow toner, the cyan toner, and the magenta toner are applied on the silver toner. The results are shown in Table 2.

TABLE 2

| | Brilliant Toner | | | Evaluation Fixing Temperature 190° C. |
|---|---|---|---|---|
| Example 1 | Yellow 1 | Cyan 1 | Magenta 1 | 5 |
| Example 2 | Yellow 2 | Cyan 2 | Magenta 2 | 4 |
| Example 3 | Yellow 3 | Cyan 3 | Magenta 3 | 5 |
| Example 4 | Yellow 4 | Cyan 4 | Magenta 4 | 4 |
| Example 5 | Yellow 5 | Cyan 5 | Magenta 5 | 3 |
| Example 6 | Yellow 6 | Cyan 6 | Magenta 6 | 5* |
| Example 7 | Yellow 7 | Cyan 7 | Magenta 7 | 5* |
| Example 8 | Yellow 8 | Cyan 8 | Magenta 8 | 5* |
| Example 9 | Yellow 9 | Cyan 9 | Magenta 9 | 5 |
| Example 10 | Yellow 10 | Cyan 10 | Magenta 10 | 5 |
| Example 11 | Yellow 11 | Cyan 11 | Magenta 11 | 4 |
| Example 12 | Yellow 12 | Cyan 12 | Magenta 12 | 4 |
| Example 13 | Yellow 13 | Cyan 13 | Magenta 13 | 3 |
| Example 14 | Yellow 14 | Cyan 14 | Magenta 14 | 5 |
| Comparative Example | — | — | — | 2 |

*The image has the brilliance but the deterioration of gradation is somewhat confirmed.

According to the exemplary embodiment, it is possible to obtain blue, green, and red images with brilliance. On the other hand, in the method of the related art in which a color toner is applied on a silver toner to be fixed, there is no problem in terms of practical applications but the brilliance is inferior compared with the exemplary embodiment.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming method comprising:

forming a plurality of toner images including at least the forming of a first toner image by using a first brilliant toner containing at least a brilliant pigment and a first pigment, and the forming of a second toner image by using a second brilliant toner containing at least a brilliant pigment and a second pigment, and exhibiting a different color from the first brilliant toner;

transferring at least the first toner image and the second toner image onto a recording medium in an overlapping manner; and fixing at least the first toner image and the second toner image onto the recording medium.

* * * * *